US005485178A

United States Patent [19]

Tateyama et al.

[11] Patent Number: 5,485,178

[45] Date of Patent: Jan. 16, 1996

[54] PRINTER CONTROL APPARATUS FOR SYNCHRONOUSLY CONTROLLING DRIVING OF RECORDING HEAD AND TRANSFER OF DATA

[75] Inventors: Jiro Tateyama; Naohisa Suzuki, both of Yokohama, Japan

[73] Assignee: Canon Kabushiki Kaisha, Tokyo, Japan

[21] Appl. No.: 155,916

[22] Filed: Nov. 23, 1993

Related U.S. Application Data

[63] Continuation of Ser. No. 635,870, Dec. 28, 1990, abandoned.

[30] Foreign Application Priority Data

Dec. 29, 1989 [JP] Japan ..... 1-344916
Dec. 29, 1989 [JP] Japan ..... 1-344917

[51] Int. Cl.[6] ..... B41J 2/01

[52] U.S. Cl. ..... 347/5; 395/115

[58] Field of Search ..... 347/5, 9, 57, 12, 347/211, 247; 395/115

[56] References Cited

U.S. PATENT DOCUMENTS 4,313,124 1/1982 Hara .
4,345,262 8/1982 Shirato et al. .
4,459,600 7/1984 Sato et al. .
4,463,359 7/1984 Ayata ..... 346/140 R X
4,517,578 5/1985 Tazari ..... 346/140 R
4,558,333 12/1985 Sugitani et al. .
4,558,965 12/1985 Ueda et al. .
4,615,631 10/1986 Ueda et al. .
4,639,746 1/1987 Yamamoto ..... 347/5
4,718,040 1/1988 Ayata .
4,723,129 2/1988 Endo et al. ..... 346/140 R X
4,725,158 2/1988 Ueda et al. .
4,735,515 4/1988 Ueda et al. .
4,737,041 4/1988 Nakayama ..... 347/41 X
4,740,796 4/1988 Endo et al. ..... 346/140 R
4,769,648 9/1988 Kishino ..... 346/33 R
4,829,386 5/1989 Takei ..... 346/33 R X
4,846,593 7/1989 Ueda et al. .
4,880,325 11/1989 Ueda et al. .
4,926,196 5/1990 Mizoguchi ..... 346/140 R
4,978,971 12/1990 Goetz ..... 346/33 R X
5,037,223 8/1991 Ueda et al. .
5,108,203 4/1992 Ueda et al. .

FOREIGN PATENT DOCUMENTS 59-123670 7/1984 Japan .
59-138461 8/1984 Japan .

*Primary Examiner*—Joseph W. Hartary
*Attorney, Agent, or Firm*—Fitzpatrick, Cella, Harper & Scinto

[57] ABSTRACT

A control apparatus of a printer causes a recording head to form an image by a dot matrix while scanning the recording head in a predetermined direction relative to a recording medium. The control apparatus includes a transfer unit for transferring recording data stored in a memory to the recording head, a drive control unit for driving and controlling scanning of the recording head, and a synchronizing unit for synchronously driving the transfer unit and the drive control unit.

7 Claims, 19 Drawing Sheets

ACCEL/DECEL CONTROLLER
171
DOT STEP COUNTER
165
SHIFT CLK
SHIFT REGISTER L/R
167
CM1~CM4
DIRECTION
START PHASE PATTERN REGISTER
169
PRINT ADDRESS
COMPARATOR
159
ADDRESS COUNTER
155
V/D
EN
163
TO FIG. 12B
END ADDRESS REGISTER
161
START ADDRESS REGISTER
157
START (READ)
CLK

PRINTER CONTROL APPARATUS FOR SYNCHRONOUSLY CONTROLLING DRIVING OF RECORDING HEAD AND TRANSFER OF DATA

This application is a continuation of application Ser. No. 07/635,870 filed Dec. 28, 1990, now abandoned.

BACKGROUND OF THE INVENTION

1. Field of the Invention

The present invention relates to a printer control apparatus.

2. Related Background Art

A so-called serial type recording apparatus (to be referred to as a serial printer hereinafter) having a movable part (to be referred to as a carriage hereinafter) with a recording head reciprocative in a direction perpendicular to a feed direction of a recording medium (to be referred to as a recording sheet or a sheet hereinafter) such as a sheet of paper or an OHP sheet is proposed in various forms of recording heads according to various recording schemes. Recording heads used in serial printers and, particularly, a printer for forming character, graphic, and other images by a dot matrix are classified into a wire dot recording head, a heat-sensitive recording head, a thermal transfer recording head, and an ink-jet recording head.

In a conventional printer of this type, processing for developing recording character codes or the like into dot data and transferring the dot data to a recording head is performed by a central processing unit (CPU).

When a recording speed is increased, carriage control, print data conversion, and its transfer cannot cope with the recording speed by processing of the CPU itself. In order to solve this problem, a line buffer for storing a one-scanning component (i.e., one-line data) of the recording data (print data) for the recording head is arranged, the print data is converted in advance, and the converted data is transferred. However, in so-called bidirectional printing for recording data during reciprocal movement of the carriage, the carriage is completely stopped during development of the next data upon completion of one-line printing, resulting in inconvenience.

When print data transfer is performed by only hardware, the CPU is overloaded to align the currently transferred data with the carriage position although the CPU is free from transfer of data which is being currently printed, and the problem posed by high-speed printing cannot yet be solved.

In an arrangement for recording data while the data is being exchanged with a host device, data exchange must be performed even during printing. When high-speed printing is to be performed, contention occurs between an interruption of an interface arranged to exchange the data and the printing operation, thus posing another problem.

SUMMARY OF THE INVENTION

It is an object of the present invention to solve the conventional problems described above.

It is another object of the present invention to provide a printer control apparatus for causing a recording head for forming an image by a dot matrix to record an image by scanning the recording head in a predetermined direction, comprising drive control means for driving and controlling scanning of the recording head, communication means for performing communication of data associated with recording, and synchronizing means for synchronously driving the communication means and the drive control means.

It is still another object of the present invention to cause the synchronizing means to drive transfer means in synchronism with the communication means and the drive control means, the transfer means being arranged to transfer data to the recording head from storage means for storing recording data to be supplied to the recording head.

It is still another object of the present invention to provide a printer control apparatus, wherein a circuit for driving and controlling scanning of the recording head and a data communication circuit are synchronously driven to reduce the load of the CPU to perform high-speed printing, and wherein the circuit for transferring data from the storage means for storing recording data to the recording head can also be controlled in response to the common synchronization signal, thereby further reducing the load of the CPU.

It is still another object of the present invention to provide a printer control apparatus for causing a recording head for forming an image by a dot matrix to record an image by scanning the recording head in a predetermined direction, comprising transfer means for transferring data to the recording head from storage means for storing the recording data to be supplied to the recording head, drive control means for driving and controlling scanning of the recording head, and synchronizing means for synchronously driving the transfer means and the drive control means.

It is still another object of the present invention to provide a printer control apparatus wherein a circuit for transferring data from storage means for storing recording data to a head and a circuit for driving and controlling scanning of the recording head are controlled by a common synchronization signal, so that a CPU can be concentrated on data conversion of the next line during printing, thereby performing high-speed recording.

It is still another object of the present invention to provide a printer control apparatus for causing a recording head for forming an image by a dot matrix to record an image by scanning the recording head in a predetermined direction, comprising transfer means for supplying recording data to the recording means from storage means for storing the recording data to be supplied to the recording head, drive control means for driving and controlling scanning of the recording head, and synchronizing means for synchronously driving the transfer means and the drive control means.

It is still another object of the present invention to provide a printer control apparatus for causing a recording head for forming an image by a dot matrix to record an image by scanning the recording head in a predetermined direction, comprising drive control means for driving and controlling scanning of the recording head, communication means for performing recording data communication, and synchronizing means for synchronously driving the communication means and the drive control means.

DETAILED DESCRIPTION OF THE PREFERRED EMBODIMENTS

Preferred embodiments of the present invention will be described in detail with reference to the accompanying drawings. The present invention may be applied to a system constituted by a plurality of devices or a system constituted by a single device. The present invention is also applicable to software in which programs run in a system or apparatus to perform predetermined processing.

Figure 1A:
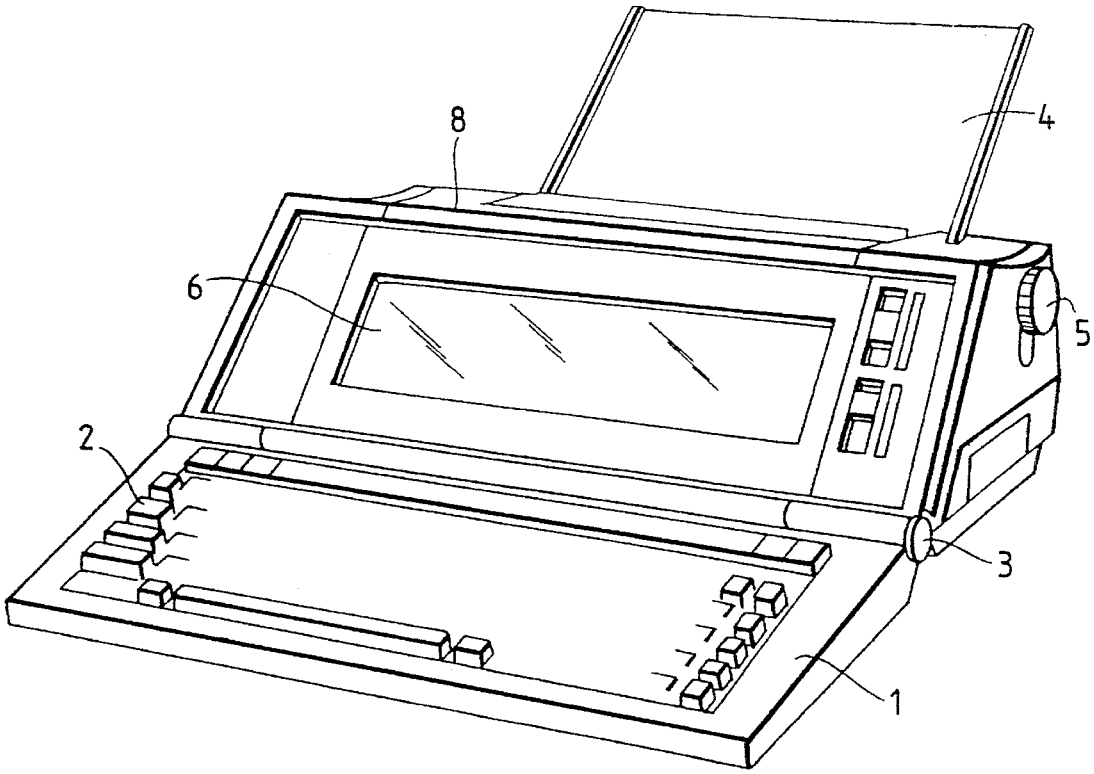
FIGS. 1A and 1B are perspective views, respectively, showing a use state and a storage state of an electronic typewriter as an apparatus according to an embodiment of the present invention.
Figure 1B:
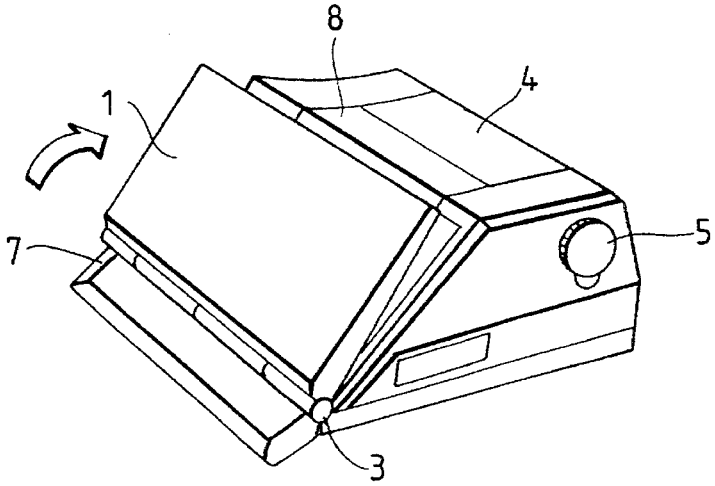

FIGS. 1A and 1B are perspective views showing an outer appearance of an electronic typewriter as an apparatus capable of employing the present invention.

The electronic typewriter includes a keyboard 1 which has keys 2 including character input keys (alphanumeric keys) and control keys. The keyboard 1 can be folded upon pivotal movement of the keyboard 1 about a hinge 3, as shown in FIG. 1B. A paper feed tray 4 feeds a sheet-like recording medium to a printer. When the typewriter is not used, the paper feed tray 4 is folded to cover the printer, as shown in FIG. 1B. The electronic typewriter also includes a feed knob 5 for manually setting a recording medium or removing it, a display 6 for displaying an input sentence or the like, and a handle 7 used to carry the electronic typewriter.

Figure 2:
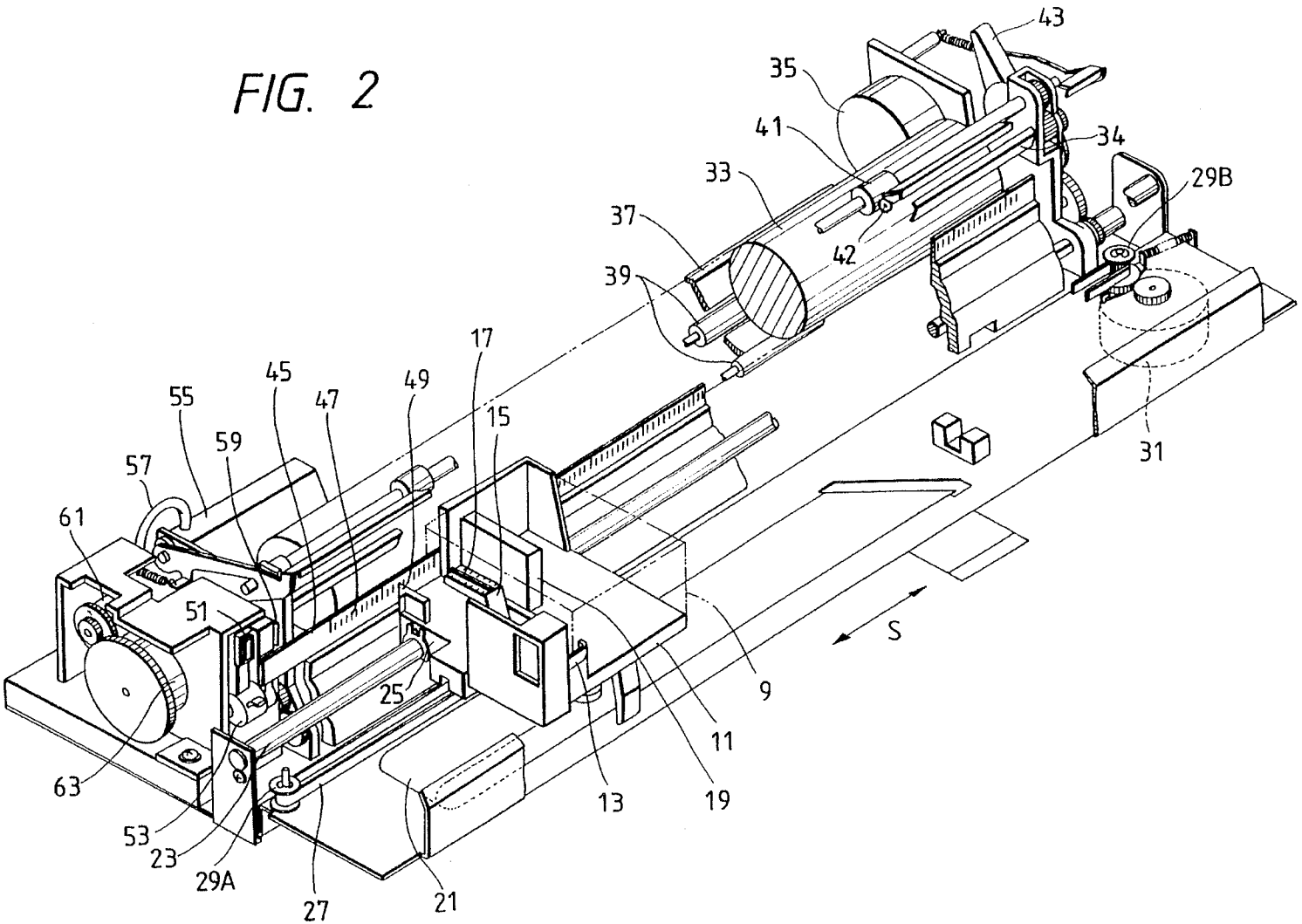
FIG. 2 is a perspective view showing an arrangement of a printer which employs the present invention.

FIG. 2 shows an arrangement of the printer according to this embodiment.

A head cartridge 9 has an ink-jet recording head to be described in detail with reference to FIGS. 3 and 4. A carriage 11 carries the head cartridge 9 thereon and scans it in directions indicated by a double-headed arrow S. A hook 13 mounts the head cartridge 9 on the carriage 11. The hook 13 is operated by a lever 15. A marker 17 is formed on the lever 15 to indicate a scale to read a print position and a set position of the recording head. A support plate 19 supports an electrical connector for the head cartridge 9. A flexible cable 21 connects the electrical connector and a controller in the main body.

A guide shaft 23 reciprocally guides the carriage 11 in the directions of the arrow S and is inserted into a bearing 25 of the carriage 11. A timing belt 27 is fixed to the carriage 11 and transmits a mechanical power to move the carriage 11 in the directions of the arrow S. The timing belt 27 is looped around pulleys 29A and 29B arranged at both sides of the typewriter. A driving force is transmitted from a-carriage motor 31 to the pulley 29B through a transmission mechanism such as a gear mechanism.

A convey roller 33 defines a recording surface of a recording medium (to be also referred to as a recording sheet) and conveys the recording sheet during recording. The convey roller 33 is driven by a convey motor 35. A paper pan 37 guides a recording medium from the paper feed tray 4 to a recording position. Feed rollers 39 are located in a recording medium feed path and urge the recording medium against the convey roller 33 and convey the recording medium. A platen 34 is located at a position opposite to jet ports of the head cartridge 9 and defines the recording surface of the recording medium. Discharge rollers 41 are located from the upstream side to the recording position and the downstream position of the recording medium convey direction to discharge the recording medium toward a discharge port (not shown). Spurs 42 are arranged in correspondence with the discharge rollers 41 and urge the rollers 41 toward the recording medium to cause the discharge rollers 41 to generate a convey force for the recording medium. A release lever 43 releases biasing of the feed rollers 39, a press plate 45, and the spurs 42 at the time of setting a recording medium.

The press plate 45 prevents the recording medium from floating near the recording position and assures a tight contact state of the recording medium with respect to the convey roller 33. In the main body, the recording head is an ink-jet recording head for performing recording by injecting ink. A distance between the ink jet port forming surface of the recording head and the recording surface of the recording medium is relatively small. At the same time, a distance between the recording medium and the jet port forming surface must be strictly controlled in order to prevent their contact. Therefore, it is very effective to prevent this contact by arranging the press plate 45. A scale 47 is formed on the press plate 45, and a marker 49 is formed on the carriage 11 in correspondence with the scale 47. The print position and set position of the recording head can be read.

A cap 51 made of an elastic material such as rubber is formed at a home position opposite to the ink jet port forming surface of the recording head. The cap 51 is brought into contact with or separated from the recording head. The cap 51 is used to protect the recording head in a non-recording mode or to restore ejection of the recording head. Ejection recovery processing is to drive energy generation elements arranged inside the ink jet ports and utilized to eject ink and to eject the ink from all jet ports, thereby removing bubbles, dust, and a viscous ink not suitable for recording (this operation is called a preliminary jet operation), and to eliminate any defective jets by forcibly ejecting the ink from the jet ports.

A pump 53 applies a suction force for forcible ink discharge and draws ink during jet recovery processing by forcible discharge or jet recovery processing by the preliminary jet operation. A waste ink tank 55 stores waste ink drawn by the pump 53, and a tube 57 causes the pump 53 and the waste ink tank 55 to communicate with each other.

A blade 59 wipes the jet port forming surface and can be moved between a position where the blade 59 extends toward the recording head to wipe the ink during head movement and a retracted position where the blade 59 is not engaged with the jet port forming surface. The arrangement shown in FIG. 2 also includes a motor 61, and a cam device 63 for receiving power from the motor 61 and drives the cap 51 and the blade 59.

A detailed arrangement of the head cartridge 9 will be described below.

Figure 3:
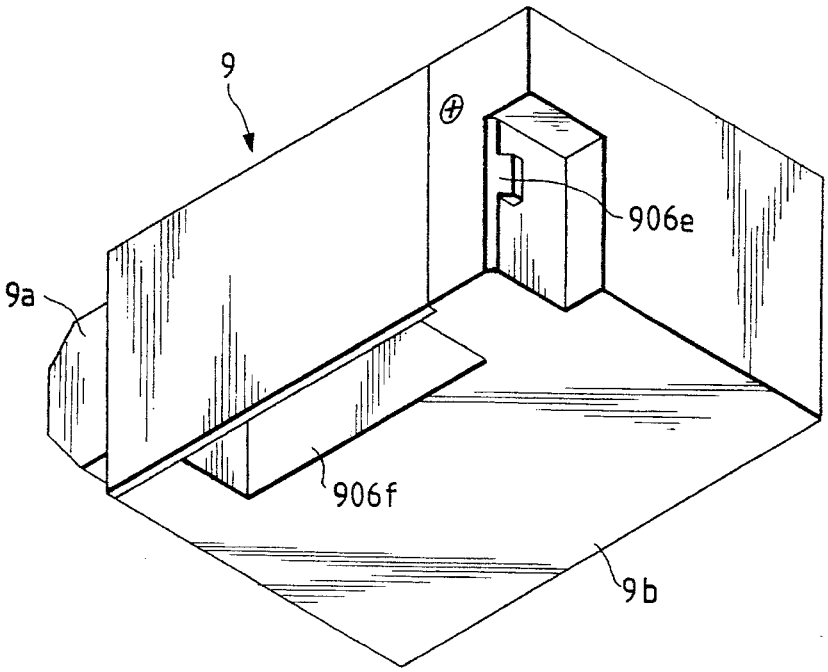
FIG. 3 is a perspective view showing an outer appearance of a head cartridge shown in FIG. 2.

FIG. 3 is a perspective view showing the outer appearance of the head cartridge 9 integrally having a jet unit 9*a* serving as an ink-jet recording head main body and an ink tank 9*b*. Referring to FIG. 3, a ratchet 906*e* is formed on the cartridge 9 to engage with hook 13 of carriage 11 to mount the head cartridge 9 thereon. As is apparent from FIG. 3, the ratchet 906*e* is formed inside the entire length of the recording head. A positioning abutment (not shown) is formed near the jet unit 9*a* of the head cartridge 9. A head opening 906*f* receives a flexible board (electrical connector) standing on the carriage 11 and a support plate for supporting a rubber pad.

Figure 4B:
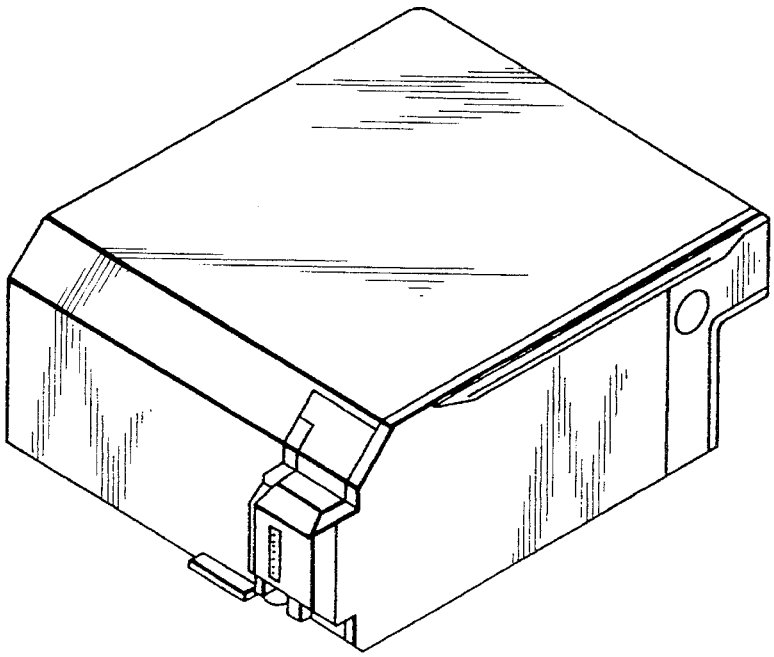
FIGS. 4A and 4B are an exploded perspective view and a perspective view, respectively, showing the head cartridge shown in FIG. 3.
Figure 4A:
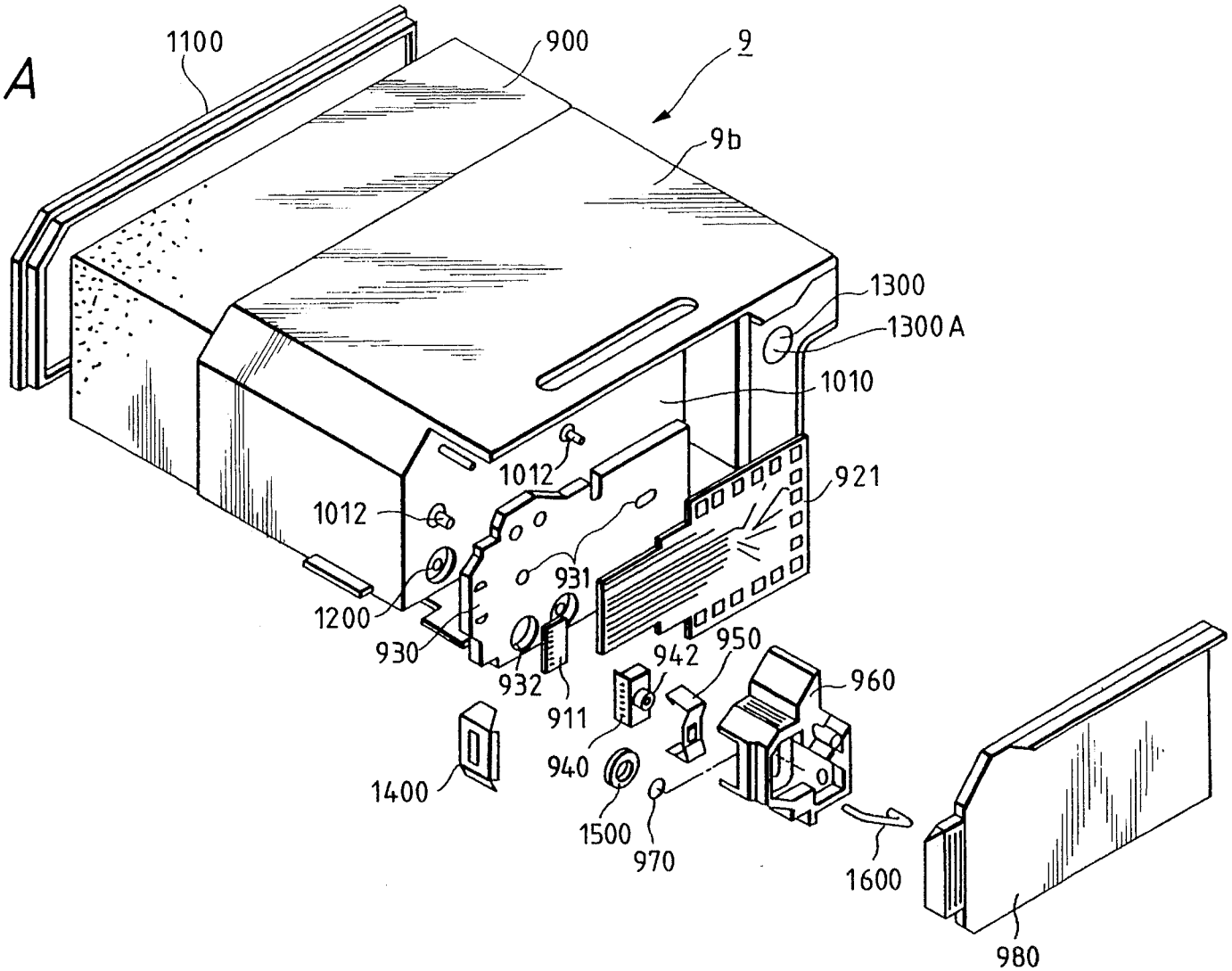

FIGS. 4A and 4B show exploded and perspective views of the head cartridge shown in FIG. 3. The head cartridge may be of a disposable type integrally including an ink storage tank serving as an ink source.

Referring to FIG. 4A, a heater board 911 on which an electrothermal conversion element (jet heater) and a wiring of, e.g., A1 for supplying power to the electrothermal conversion element are formed on an Si substrate by a film formation technique. A wiring board 921 is arranged for the heater board 911, and the corresponding wiring lines are connected by wire bonding or the like.

A top plate 940 has a partition wall for defining an ink path and a common liquid chamber. In this embodiment, an orifice plate portion is integrally made of a resin material.

The heater board 911 and the top plate 940 are sandwiched between a metal support 930 and a press spring 950, so that the heater board 911 and the top plate 940 are brought into tight contact with and fixed to each other. However, note that the support 930 may be adhered to the wiring board 921, and the support 930 may have a positioning reference for the carriage 11 for scanning the recording head. The support 930 also serves as a member for dissipating heat and cooling the heater board 911 upon driving of the typewriter.

A supply tank 960 serves as a sub-tank for receiving an ink from the ink tank 9*b* serving as an ink source and guiding an ink to a common liquid chamber formed between the heater board 911 and the top plate 940. A filter 970 is located inside the supply tank 960 near an ink supply port to the common liquid chamber. The supply tank 960 has a lid member 980.

An absorber 900 is arranged in the ink tank main body 9*b*. A supply port 1200 supplies ink to the recording element consisting of the members 911 to 980. Before the unit is arranged in a portion 1010 of the ink tank main body 9*b*, an ink is injected into the supply port 1200 to cause the absorber 900 to absorb the ink.

The cartridge main body has a lid member 1100. An outer air communication port 1300 is formed in the lid member 1100 to cause the interior of the cartridge to communicate with cuter air. A liquid repellant 1300A is located inside the outer air communication port 1300 to prevent the ink from leaking from the outer air communication port 1300.

When the ink tank 9*b* is completely filled with the ink through the supply port 1200, the jet unit 9*a* consisting of the members 911 to 980 is located at the portion 1010. In this case, positioning or fixing can be performed by fitting projections 1012 formed on the ink tank main body 9*b* into holes 931 formed in the support 930, thereby finishing the head cartridge 9 shown in FIG. 4B.

The ink is supplied from the interior of the cartridge to the supply tank 960 through the supply port 1200, a hole 932 formed in the support 930, and a guide port formed in the lower surface of the supply tank 960 in FIG. 4A. The ink passes through the supply tank 960 and flows from the guide port to the common liquid chamber through an appropriate supply tube and an ink guide port 942 of the top plate 940. Packings made of silicone rubber, butyl rubber, or the like are fitted in the connecting portions of the above ink communication, thereby assuring sealing and an ink supply path.

Figure 5A:
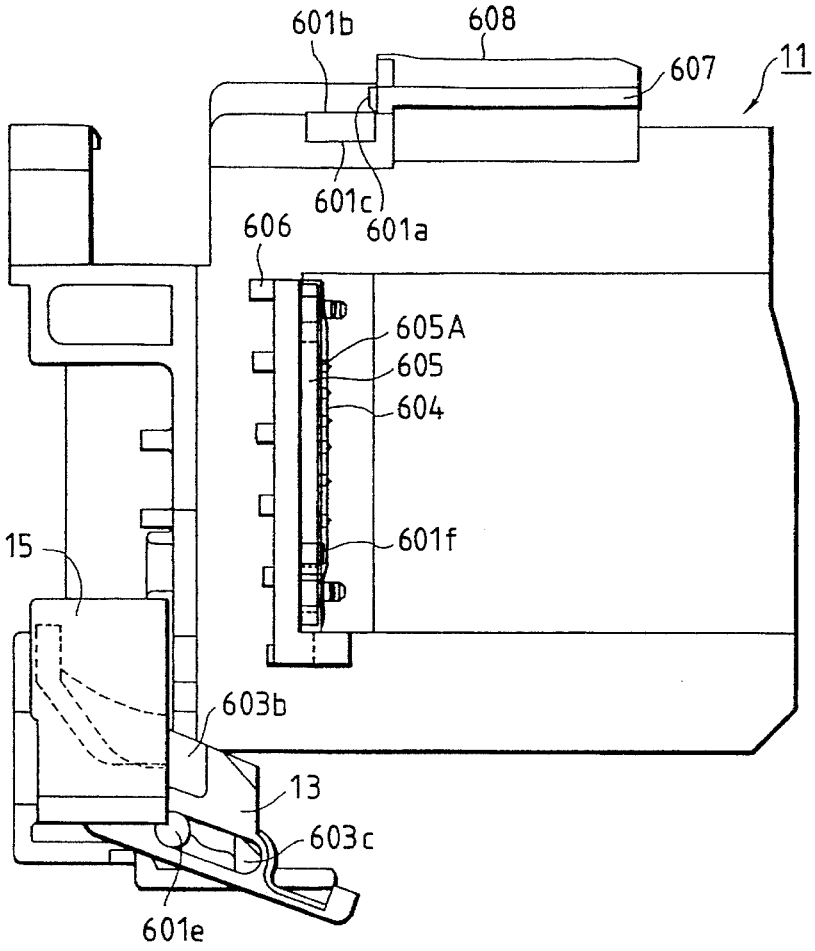
FIGS. 5A and 5B are a plan view and a side view, respectively, showing a carriage shown in FIG. 2.
Figure 5B:
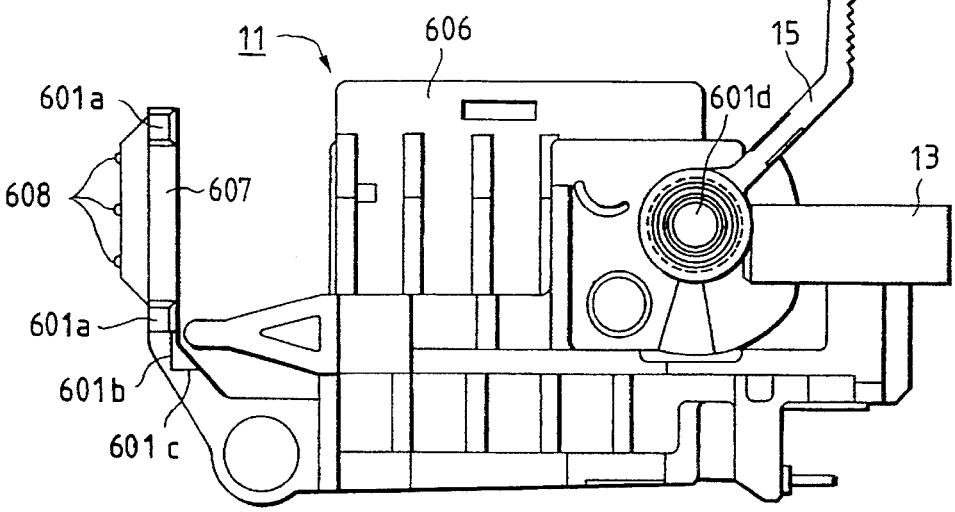

FIGS. 5A and 5B are a plan view and a left side view, respectively, showing a detailed structure of the carriage 11.

Referring to FIGS. 5A and 5B, a support plate 606 extends upright from the bottom portion of the carriage 11. The support plate 606 supports a flexible board 604 and supports rubber pads 605 having projections 605A formed in correspondence with terminal pads formed on the board 604.

An abutment member 607 stands upright on the bottom of the carriage in front of the support plate 606. The abutment member 607 has a small thickness to assure a maximum ink tank space within the limited space of the head cartridge 9 and the carriage 11. For this reason, three ribs 608 are formed on the member 607 to reinforce the strength of the member 607. An extension direction of each rib 608 is a movement direction of the carriage 11 so as to provide a high strength corresponding to a turning direction during mounting/removal of the head cartridge. The ribs 608 are formed so that they extend from the jet surface of the head cartridge 9 by about 0.1 mm when the head cartridge 9 is mounted. Therefore, even if the recording sheet extends into the movement path of the recording head due to some reason, the recording sheet is not brought into contact with the jet surface, so that damage to the jet surface can be prevented.

The operation lever 15 for attaching or detaching the head cartridge is supported on the carriage 11 to be pivotal about a shaft 601*d*. The hook 13 is used to attach or detach the head cartridge 9 when part of the hook 13 is engaged with the head cartridge 9 upon movement of engagement of the hook 13 with part of the operation lever 15. The hook 13 performs attachment or detachment described above since an elongated hole 603*c* formed in the hook 13 is guided by a guide shaft 601*e* formed on the carriage 11.

Since an attaching/detaching mechanism including the operation lever 15 and the hook 13 is arranged sideways the carriage 11, i.e., the mechanism is arranged in the movement direction of the carriage 11, the mechanism does not occupy a large dead space during movement of the carriage.

The positioning abutment portion for mounting the head cartridge will be described below.

Horizontal positioning abutment portions 601*a* are formed at side portions of the abutment member 607. Horizontal positioning is performed by an abutment portion 601*f* formed on the support plate 606 in addition to the abutment portion 601*a*.

An abutment portion 601*b* is used to position the head cartridge in the back-and-forth direction and is formed at a lower side portion of the abutment member 607.

Abutment portions 601*c* are used to position the head cartridge in the vertical direction and are formed at a lower side portion of the abutment member 607 and a lower side portion of the support member.

Figure 6A:
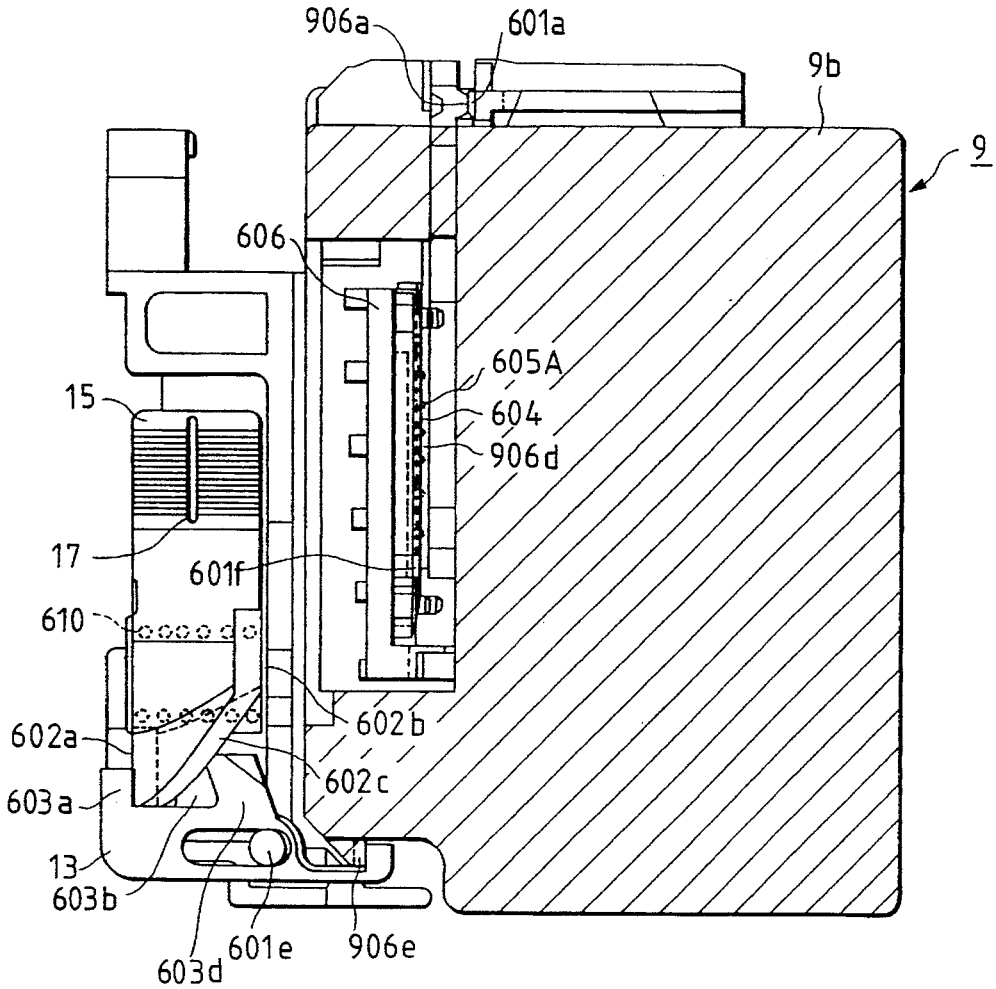
FIGS. 6A and 6B are a plan view and a side view, respectively, showing a state wherein the head cartridge is mounted on the carriage.
Figure 6B:
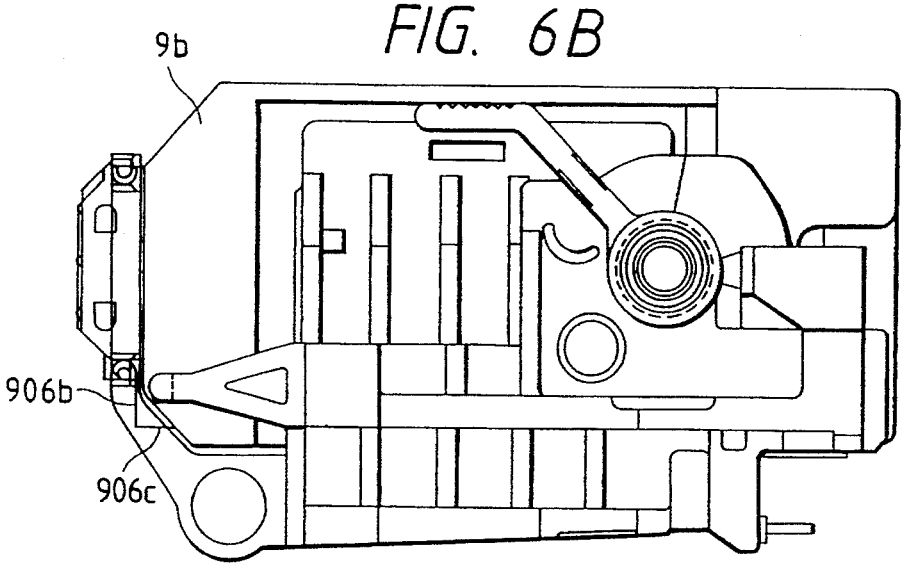

FIGS. 6A and 6B are a plan view and a left side view, respectively, showing a state wherein the head cartridge 9 is mounted on the carriage 11.

Referring to FIGS. 6A and 6B, an abutment portion 906*a* is formed on the head cartridge 9 to be brought into contact with the abutment portion of the carriage 11 at the time of mounting the recording head. Abutment portions 906*b* and 906*c* correspond to the abutment portions 601*b* and 601*c*.

Engaging relationships of the respective parts upon mounting of the recording head will be generally described with reference to FIG. 6A.

The abutment portion 906*a* of the head cartridge 9 abuts against the abutment portion 601*a*. At the same time, the abutment portion 906*a* and a ratchet 906 of the head cartridge 9 receive a left force by a biasing force of a coil spring 610 through the hook 13. Therefore, the head cartridge 9 receives a moment rotated about the above abutment. At this time, a board 906*d* formed in the head abuts against an abutment portion 601*f*. As a result, the horizontal positioning of the head cartridge 9 is performed, and this position is maintained.

A projection 605A of the, rubber pad 605 is compressed and deformed by contact with the board 906*d*. By this deformation, a force is generated to bring the terminal pad of the flexible board 604 into tight contact with the terminal of the board 906*d*. In this case, since the abutment portion 601*f* is kept in contact with the board 906*d*, a deformation amount of the projection 605A is kept constant, thereby obtaining a stable contact force.

In FIGS. 6A and 6B, a compressed and deformed state of the projection 605A is not illustrated.

Positioning of the head cartridge 9 in the back-and-forth and vertical directions is performed during mounting of the head cartridge 9.

Figure 7:
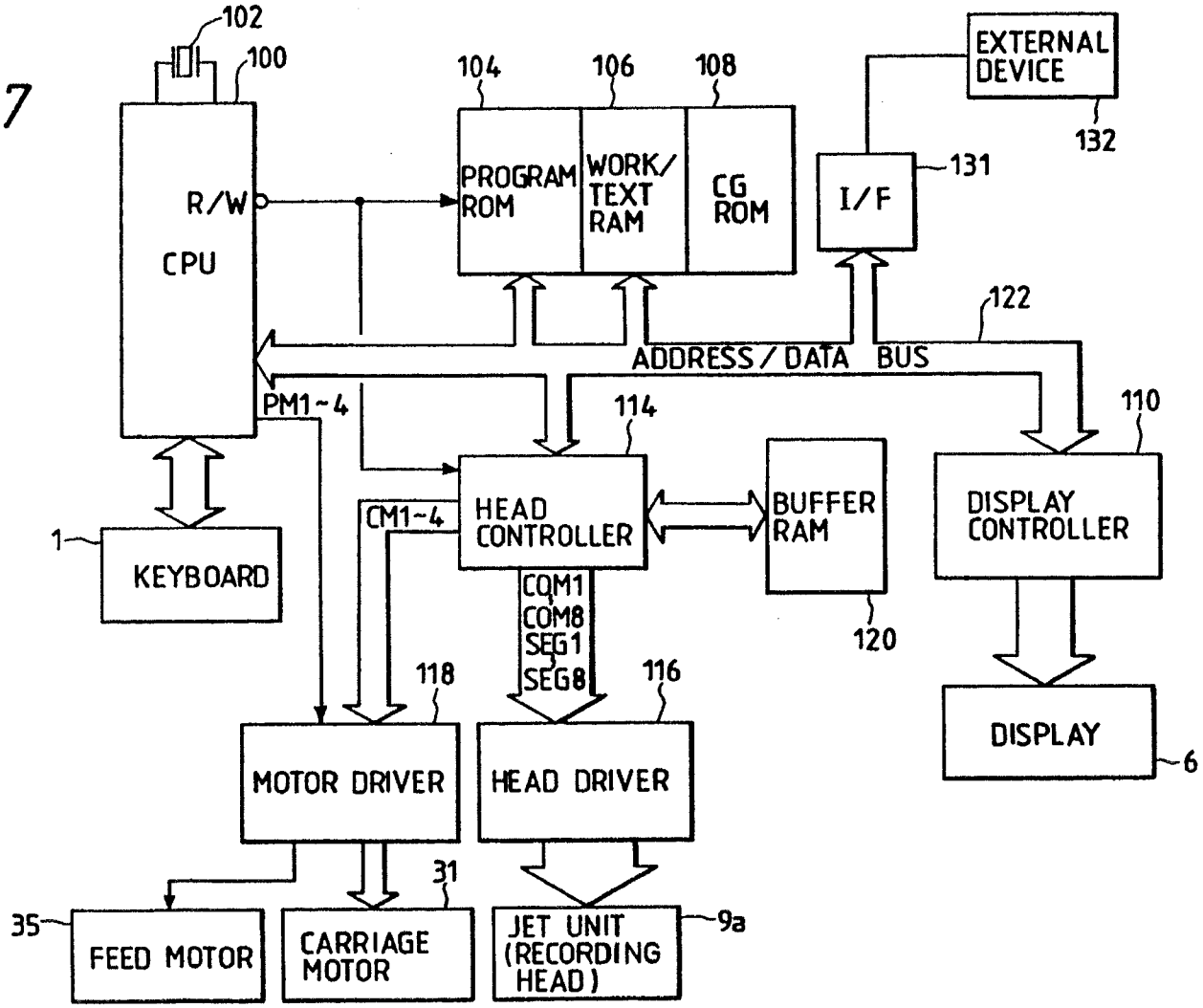
FIG. 7 is a block diagram showing an arrangement of a control system of a character processing apparatus according to this embodiment.

FIG. 7 shows an arrangement of a control system in a character processing apparatus according to this embodiment.

A CPU 100 comprises a microprocessor serving as a main controller. The CPU 100 performs predetermined processing on the basis of data input from the keyboard 1 and control signals. A quartz oscillator 102 generates fundamental clocks which define operation timings of the respective components. A ROM 104 stores programs corresponding to recording control sequences executed by the CPU 100 and other permanent data. A RAM 106 has storage areas for work data used as registers and a development area for documents (texts). A ROM 108 is used as a character generator. A display controller 110 causes a display such as a liquid crystal display (LCD) to display data.

A head controller 114 (to be described in detail with reference to FIG. 12) generates control signals (COM1 to COM8 and SEG1 to SEG8) for a head driver 116 for driving jet energy generation elements of the jet unit (recording head) 9*a*. A motor driver 118 drives the carriage motor 31 and the convey motor 35. The drive control signals COM1 to COM4 for the carriage motor 31 are supplied from the head controller 114, and drive control signals PM1 to PM4 for the convey motor 35 are supplied from the CPU 100.

A RAM 120 serves as a buffer for storing one-line received data or one-line recording data obtained by processing the one-line received data. An address data bus 122 connects the components 104, 106, 108, 110, and 114. A control signal R/W switches the read and write states of the components 104 to 108 and 114.

Figure 8:
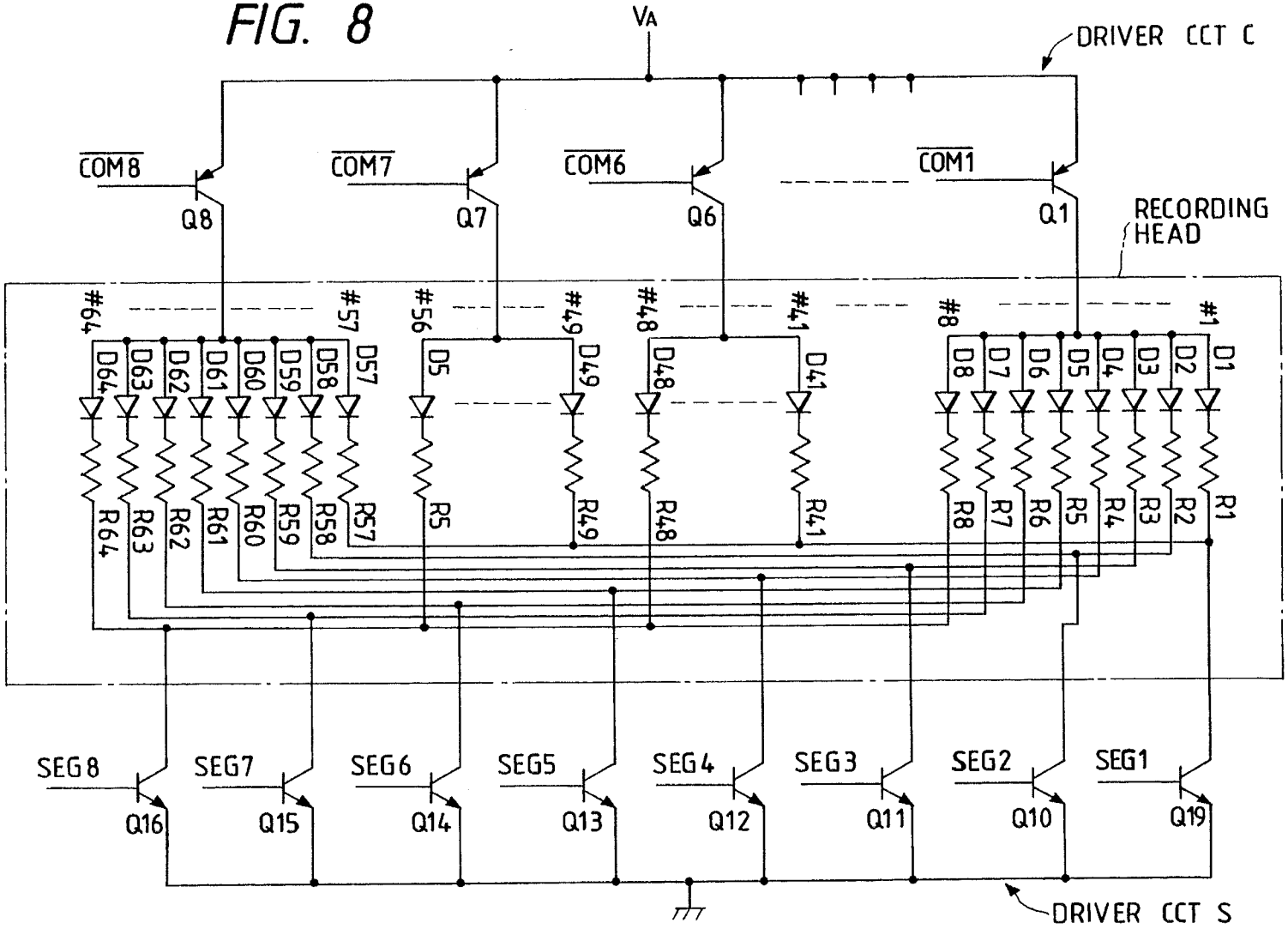
FIG. 8 is a circuit diagram showing an electrical arrangement of a recording head and a head driver in a printer in the character processing apparatus of this embodiment.

FIG. 8 shows an electrical arrangement of the recording head and the head driver 116.

In this embodiment, the jet unit 9*a* has 64 jet ports. Reference characters #1 to #64 represent numbers corresponding to the positions of the jet ports formed in the jet unit 9*a*. Heating resistors R1 to R64 serve as jet energy generation elements formed in correspondence with the jet ports #1 to #64. The heating resistors R1 to R64 are divided into blocks each consisting of eight heating resistors. Switching transistors Q1 to Q8 in a common driver circuit C are respectively connected to the blocks. The transistors Q1 to Q8 are turned on/off to connect/disconnect the energization path in response to control signals $\overline{\text{COM1}}$ to $\overline{\text{COM8}}$. Diodes D1 to D64 are arranged in energization paths for the heating resistors R1 to R64 to prevent a reverse flow.

Figure 9:
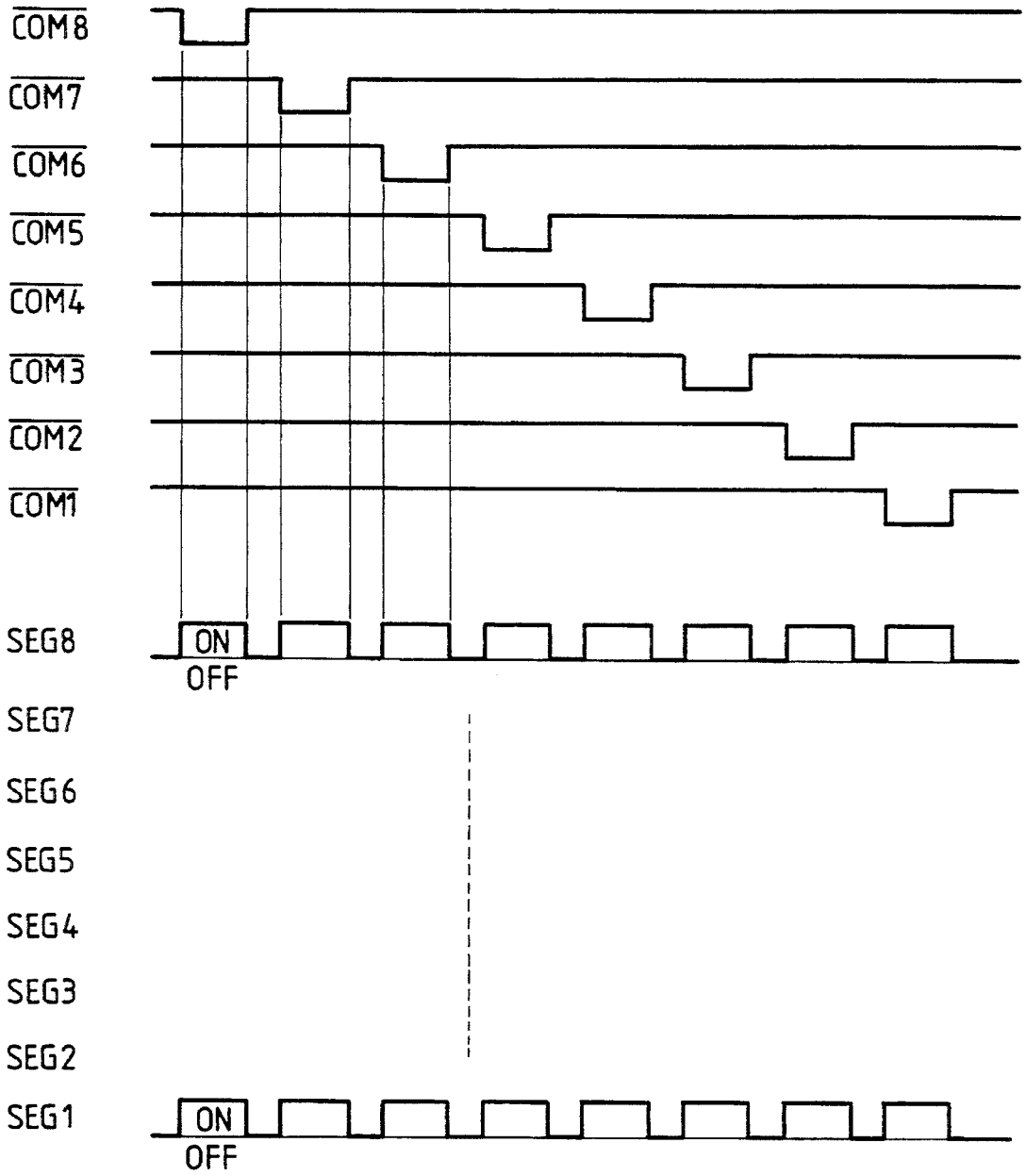
FIG. 9 is a timing chart for driving the head.

On/Off transistors Q9 to Q16 in a segment driver S are connected to corresponding heating resistors of the respective blocks. The transistors Q1 to Q16 are turned on/off to connect/disconnect the energization paths for the heating resistors in response to ON/OFF states of control signals SEG1 to SEG8. FIG. 9 is a timing chart for driving the head having the above-mentioned arrangement. The common control signals $\overline{\text{COM8}}$ to $\overline{\text{COM1}}$ are sequentially turned on at a given position in the head driving direction. Upon turning on of each common signal, one corresponding block is selected to be energized. Therefore, segment-control signals SEG8 to SEG1 are turned on/off in accordance with the image to be recorded within the block. Thus, the heating resistors are selectively energized to eject the ink upon heating, thereby performing dot recording.

Figure 10:
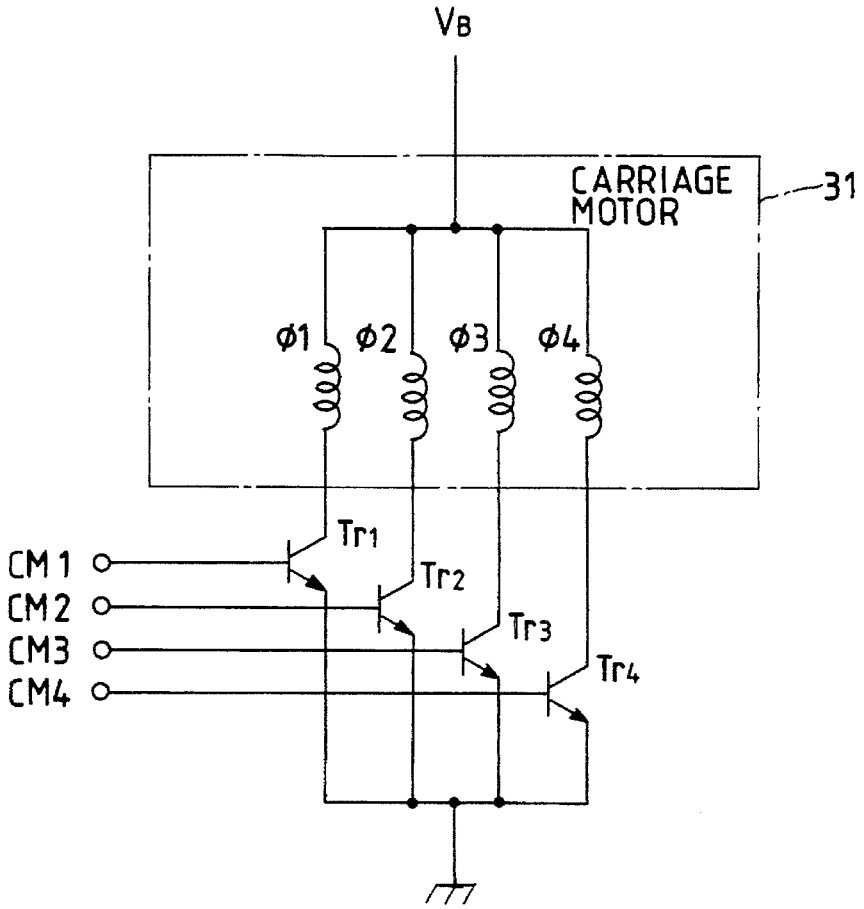
FIG. 10 is a circuit diagram showing an arrangement of a carriage motor and a motor driver in the printer according to this embodiment.
Figure 11:
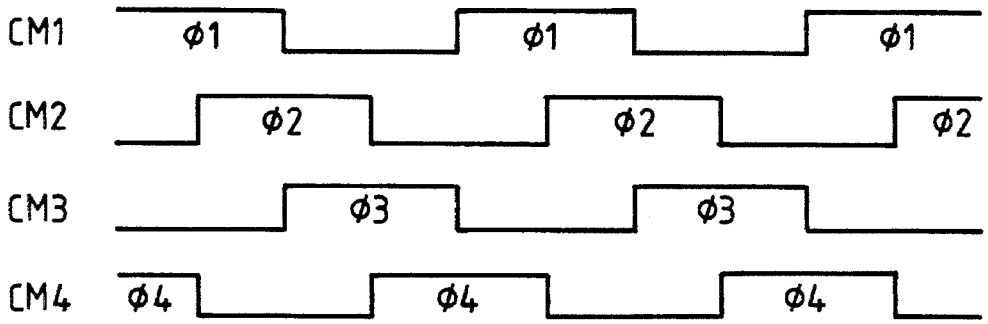
FIG. 11 is a timing chart for driving the motors.

FIG. 10 is a circuit diagram showing the main part of the carriage motor 31 and the motor driver 118, and FIG. 11 is a timing chart for driving the carriage motor 31 and the motor driver 118. In this embodiment, the carriage motor 31 comprises a stepping motor having coils $\phi$1 to $\phi$4. The switching transistors Tr1 to Tr4 connected to the respective coils are properly driven in response to drive signals CM1 to CM4, thereby driving the motor in accordance with a two-phase excitation scheme, as shown in FIG. 11.

Figures 12, 12A, 12B:
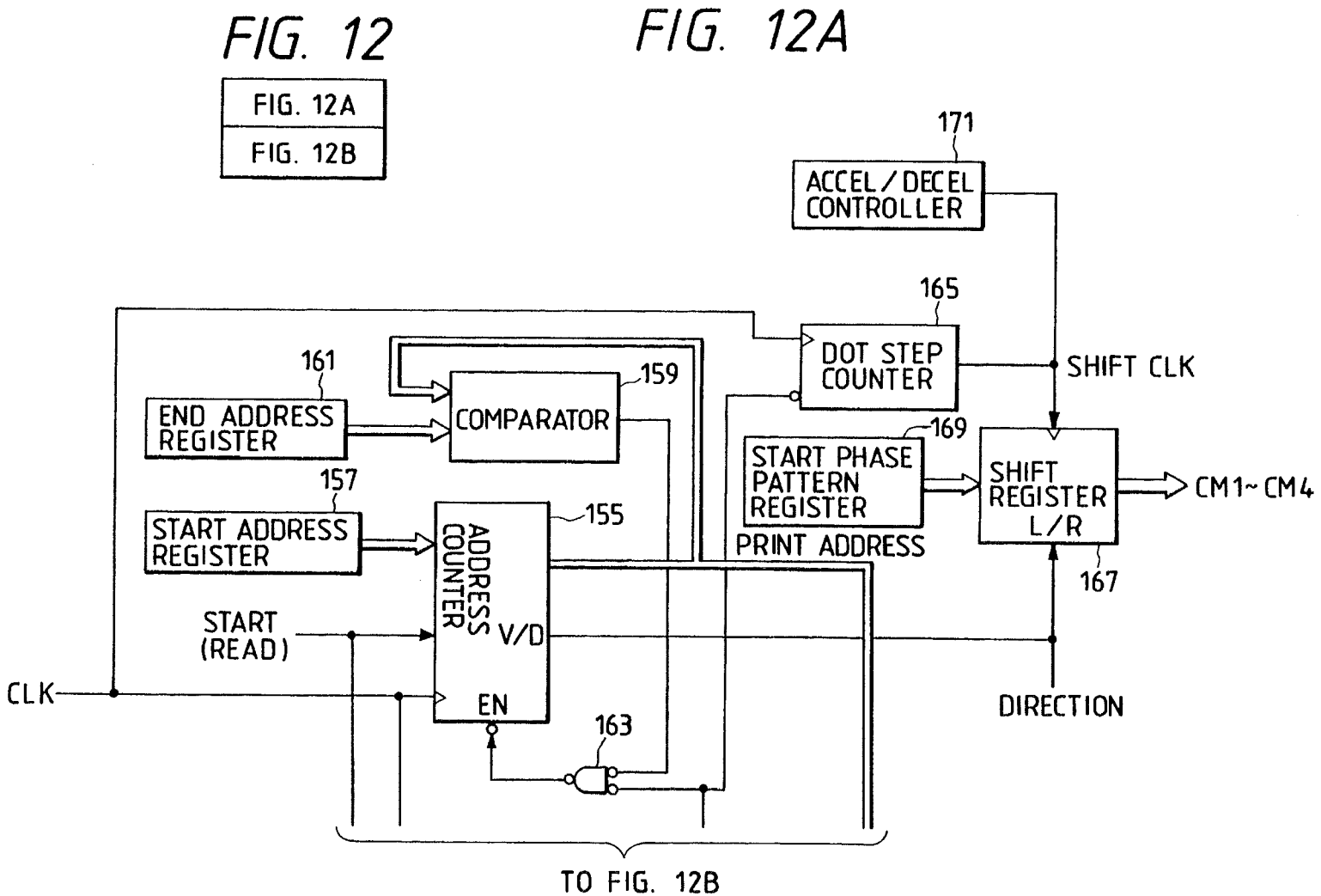
FIGS. 12, 12A and 12B are a block diagram showing an arrangement of a head controller serving as a control apparatus of the printer according to this embodiment.
Figure 12B:
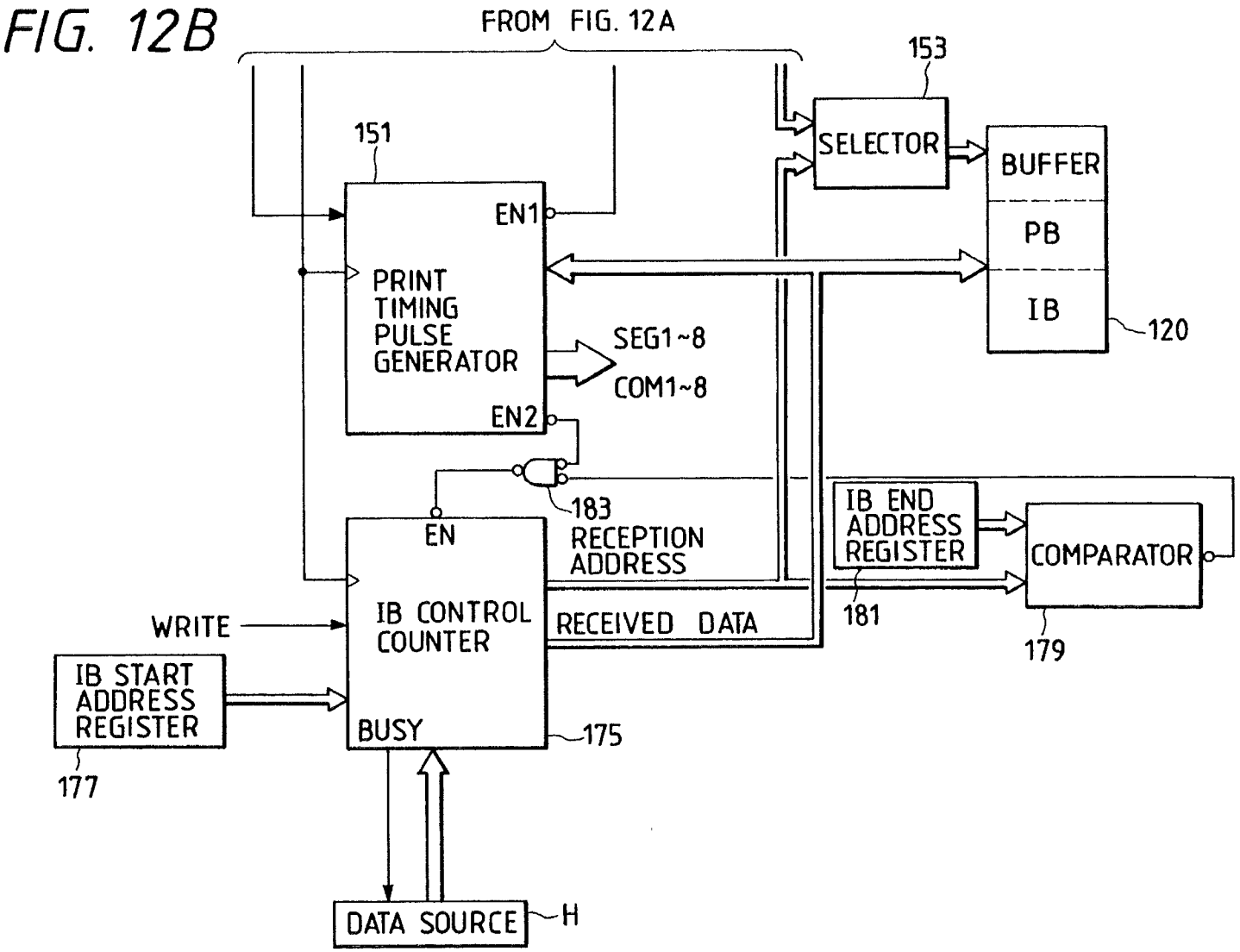

FIG. 12 is a block diagram showing a detailed arrangement of the head controller 114 according to this embodiment.

A print timing pulse generator 151 receives from the CPU 100 a signal (start signal) for instructing data read access from a recording data storage area of the buffer so as to start recording and outputs the recording head drive control signals COM1 to COM8 and SEG1 and SEG8 at timings based on the clock signals CLK. In the buffer or RAM 120, PB serves as an area (print buffer) having a one-line data capacity and for developing printing data; and IB, an area (reception buffer) for developing data received for recording. An address of one of the areas PB and IB is selected by a selector 153.

An address counter 155 comprises an up/down counter. A start address in the recording data development area PB stored in a start address register 157 is set in the address counter 155. In response to a start signal, the counter 155 performs a count-up operation in response to the clock signal CLK and outputs a count value. This count value represents a read address of the recording data development area PB, i.e., a print address read out for recording (print). A comparator 159 compares a print address output from the address counter 155 with an end address of the area PB which is stored in an end address register 161. The comparator 159 determines a coincidence between these two addresses, i.e., an end of read access to the set end address.

The print timing pulse generator 151 disables an enable signal EN1 for enabling an operation of the address counter 155 during a period except for a period for generating the signals COM1 to COM8 and stops an operation of a gate 163. The operation of the address counter 155 is also stopped when the comparator 159 outputs a coincidence signal.

A dot step counter 165 receives the clock signal CLK, i.e., a clock CLK for determining a print timing and outputs a signal for driving the carriage motor 31 as a stepping motor stepwise every predetermined number of dots in the scanning direction. The signal as a shift clock from the dot step counter 165 is input to a shift register 167 for generating the excitation signals CM1 to CM4. A start phase pattern register 169 sets a phase pattern at the start of the carriage motor 31.

In this embodiment, the address counter 155 comprises an up/down counter, and the shift register 167 comprises a bidirectional register. The counting direction of the address counter 155 is switched in response to, e.g., a scanning direction switching signal (direction signal) supplied from the CPU 100 to change the read order of the data from the recording data buffer PB. At the same time, the shift direction of the shift register 167 is changed to change the rotational directs on of the motor 31, thereby performing so-called bidirectional printing. In this embodiment, an ACCEL/DECEL controller 171 is arranged to supply an acceleration/deceleration shift clock different from the shift clock output from the dot step counter 165 so as to cause the motor speed to reach a recording speed before the carriage reaches the recording area in the carriage scanning direction and to immediately stop the carriage motor after the recording area. The ACCEL/DECEL controller 171 includes a frequency divider or a doubler for dividing or doubling a predetermined clock signal (the clock signal CLK may be used) at a predetermined frequency division or doubling ratio, a memory (e.g., a predetermined area of the ROML 104) for storing a frequency division or doubling ratio table corresponding to an acceleration or deceleration pattern, and the like.

An IB control counter 175 outputs an IB address (reception address) signal for a destination to the selector 153 when received data is to be stored in the reception buffer IB. A start address of the reception buffer IB which is stored in an IB start address register 177 is set in the IB control counter 175. The IB control counter 175 starts a count-up operation in response to a write signal, continues it in synchronism with the clock signal CLK, and outputs a count value. A comparator 179 compares the reception address output from the counter 175 with the end address of the reception buffer IB which is stored in an IB end address register 181. The comparator 179 determines a coincidence between these two addresses, i.e., an end of storage of the received data until the set IB end address.

The print timing pulse generator 151 disables the enable signal EN1 for enabling an operation of the IB control counter 175 during a period of generating the signals COM1 to COM8. At this time, the operation of the counter 175 is stopped and outputs a busy signal BUSY to the data transmission source, thereby informing that the data cannot be received. The operation of the counter 175 is stopped when the comparator 179 determines a coincidence between the IB end address and the reception address.

A data source H serves as a host device for the head controller. Referring to FIG. 7, the data source H may be an equipment 132 connected to the data bus 122 through a CENTRONIC interface 131, or may be the RAM 106 for storing document data (text) input from such an equipment without processing. The data received from the data source H is developed in the reception buffer IB, and the stored data is read out at an appropriate timing prior to recording. The readout data is processed in an appropriate recording format and is stored in the recording data buffer PB.

The registers 157, 161, 169, 177, and 181 can be allocated as predetermined areas of the RAM 106.

Figure 13:
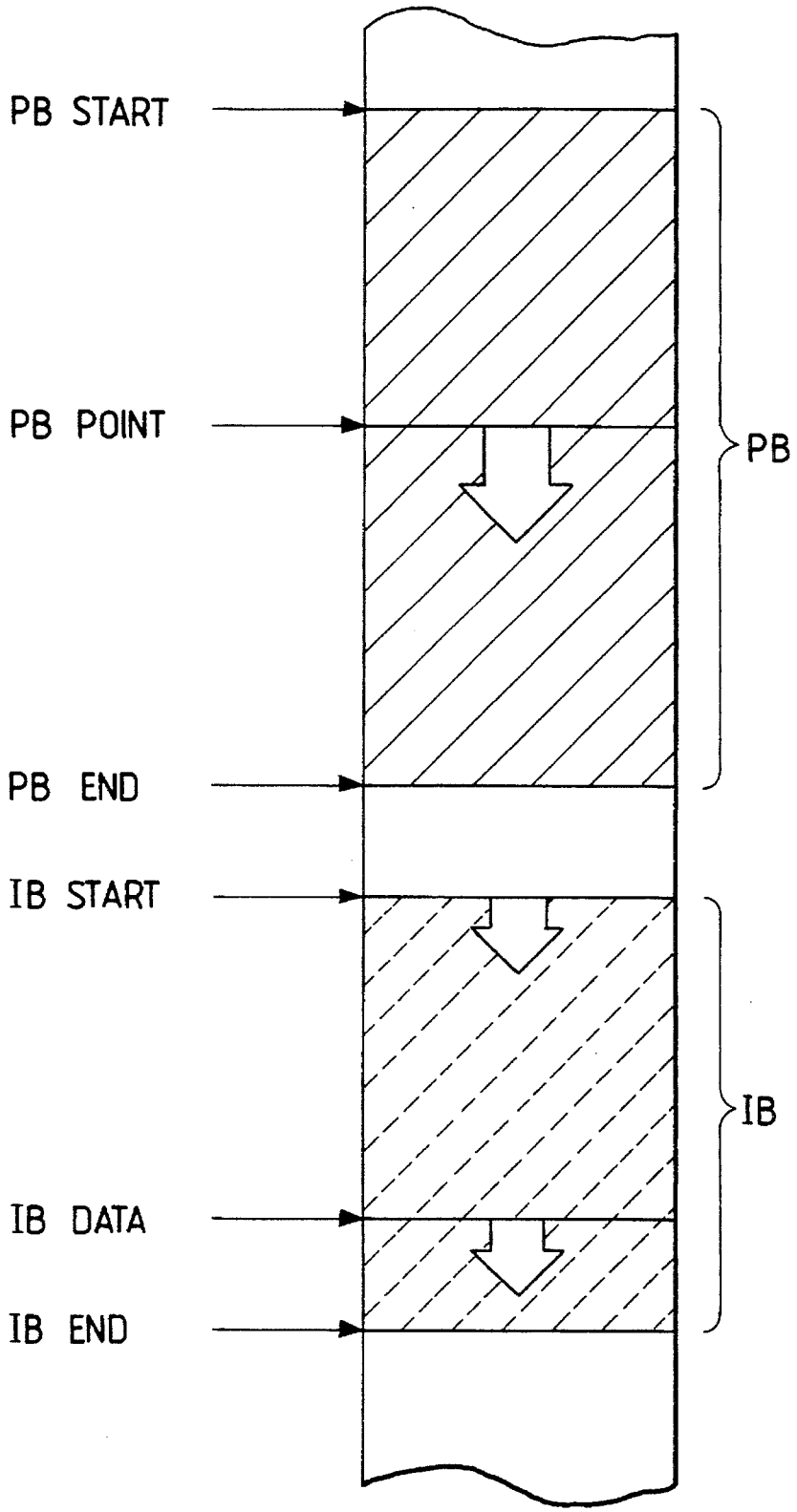
FIG. 13 is a view for explaining the layout of a memory space of a buffer for storing recording data.

FIG. 13 shows a data format of a memory area of the recording data buffer area PB and the reception buffer area IB in the RAM 120. In this manner, the recording data buffer area PB is defined ranging from a print start address PBSTART to a print end address PBEND, which are represented by the contents of the start address register 157 and the end address register 161. The reception buffer area IB is defined ranging from a received data start address IB START to a received data end address IB END, which are represented by the contents of the IB start address register 177 and the IB end address register 181. PB POINT in FIG. 13 represents a pointer (print end address pointer) representing an address of an end of printing in the recording data buffer area PB and corresponds to the content of the address counter 155. IB DATA represents an address (data reception end address) of an end of data reception in the reception buffer area IB and is associated with the content of the counter 175.

Figure 14:
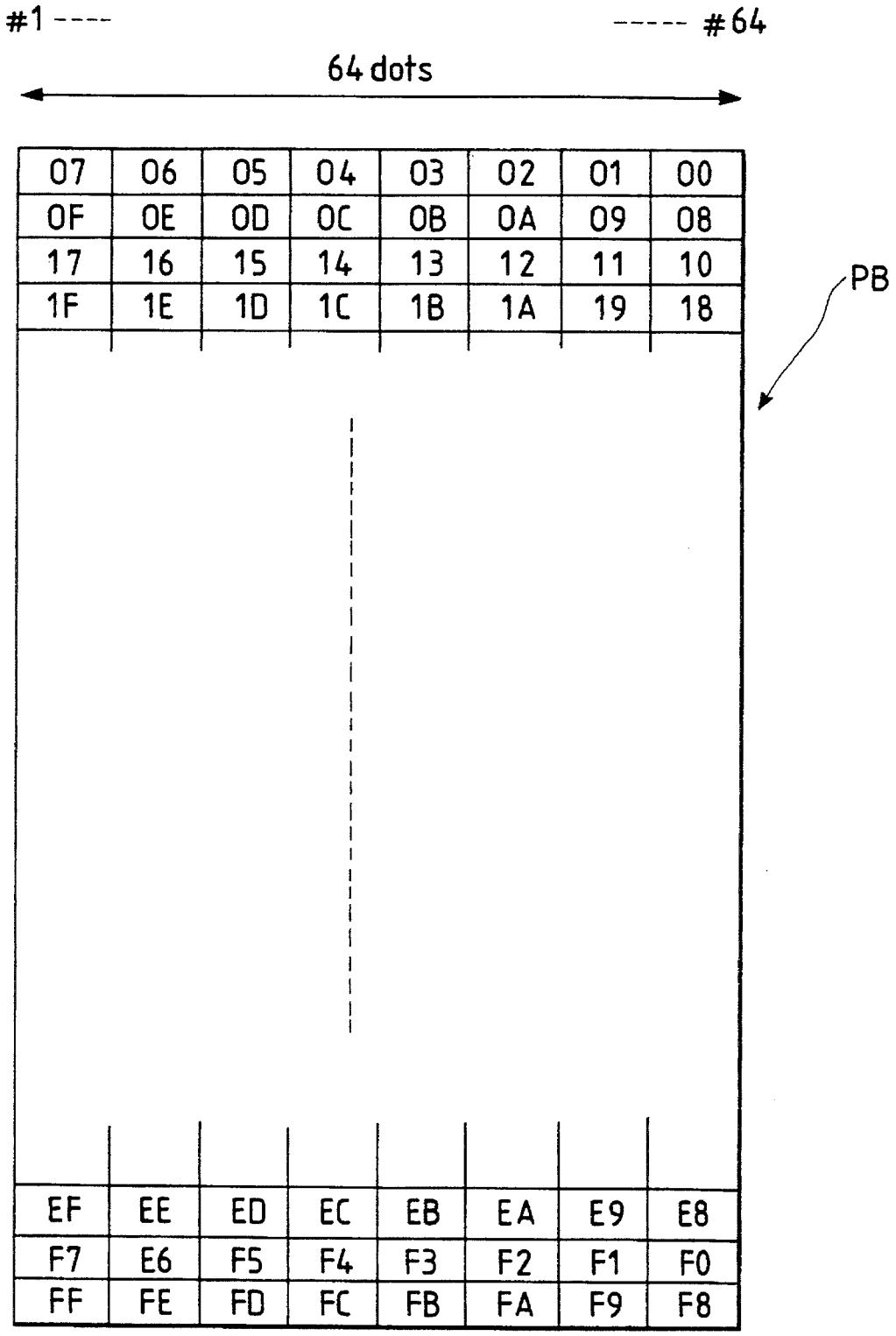
FIG. 14 is a view for explaining an address map of a recording data buffer area in the buffer.

FIG. 14 is a view for explaining an address map of the recording data buffer area PB. 8-bit data are respectively stored at addresses "00" to "FF" (these addresses will be represented as addresses $00 to $FF hereinafter). One bit corresponds to one dot of recording data. The number of bits included in each of the address groups $00 to $07, $08 to $0F, . . . $F8 to $FF correspond to 64 dots in the recording elements. In each address group, the bits correspond to the jet port numbers #1 to #64, as shown in FIG. 14. One-line (i.e., a line recorded by one recording head operation) data is developed in the data buffer area PB. For the illustrative convenience, the data are illustrated up to address $FF.

In contrast to the structure of the recording data buffer area corresponding to the actual dot recording data, the reception buffer IB stores data in the form of, e.g., codes, received from the data source H. The reception buffer IB is smaller than the area PB.

Figure 15:
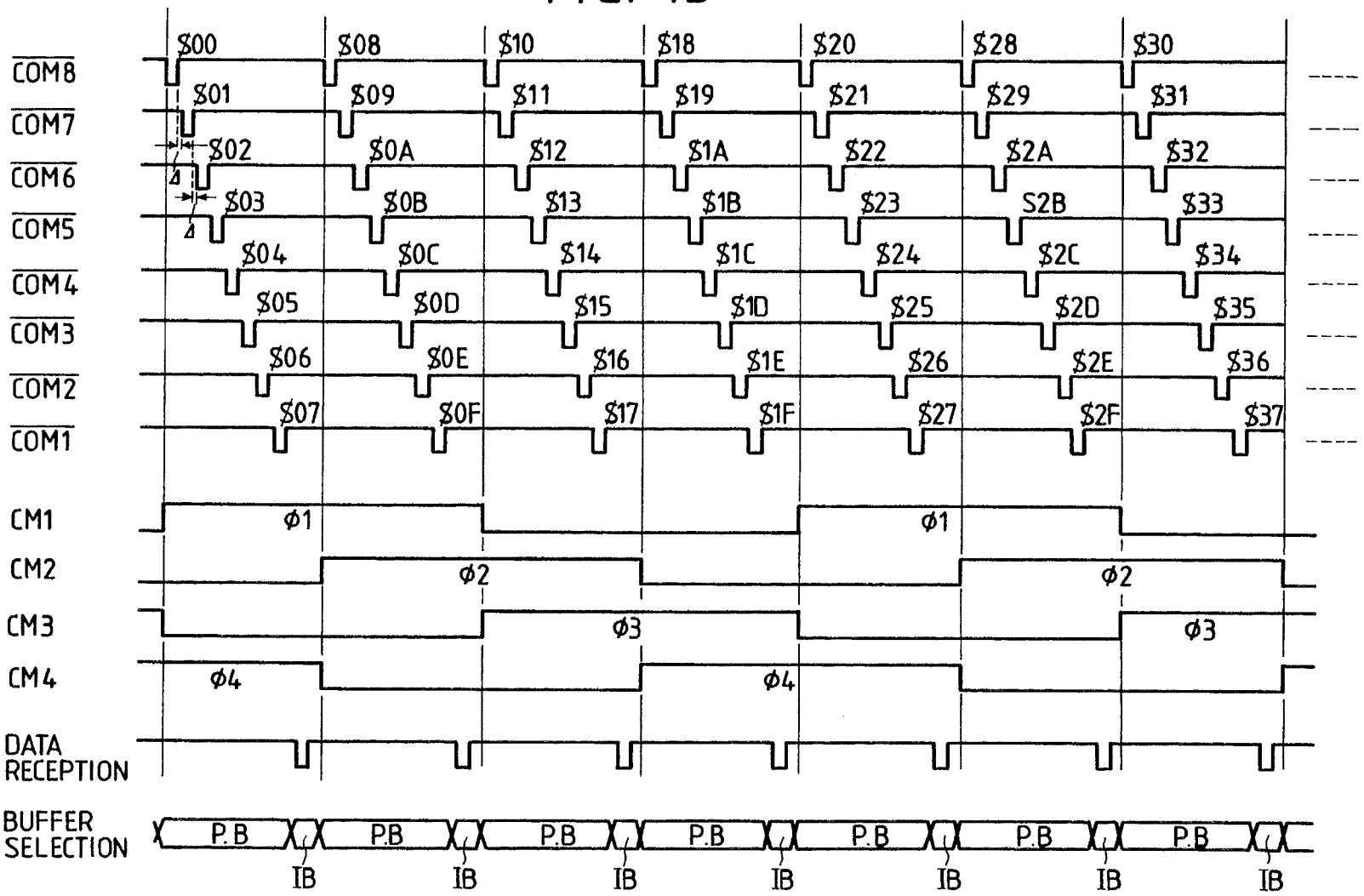
FIG. 15 is a timing chart showing operation timings of the respective components in the head controller according to this embodiment of the present invention.

FIG. 15 is a timing chart showing output timings of the signals $\overline{\text{COM8}}$ to $\overline{\text{COM18}}$ in the recording mode, output timings of the motor drive signals CM1 TO CM4, data reception timings, and selection timings of the areas PB and IB. In FIG. 15, one dot in the scanning direction is caused to correspond to one step of the motor.

As shown in FIG. 15, the buffer area PB is selected to record data at a given position in the scanning direction. Addresses (e.g., $00 to $07) at which data to be printed are stored at this position are sequentially selected, and the signals COM8 to COM1 are sequentially output. The signals SEG8 to SEG1 are sequentially output at output timings in correspondence with the data shown in FIG. 9, thereby performing recording. The buffer area IB is selected at the end of recording at this position, and the received data is stored.

Figure 16:
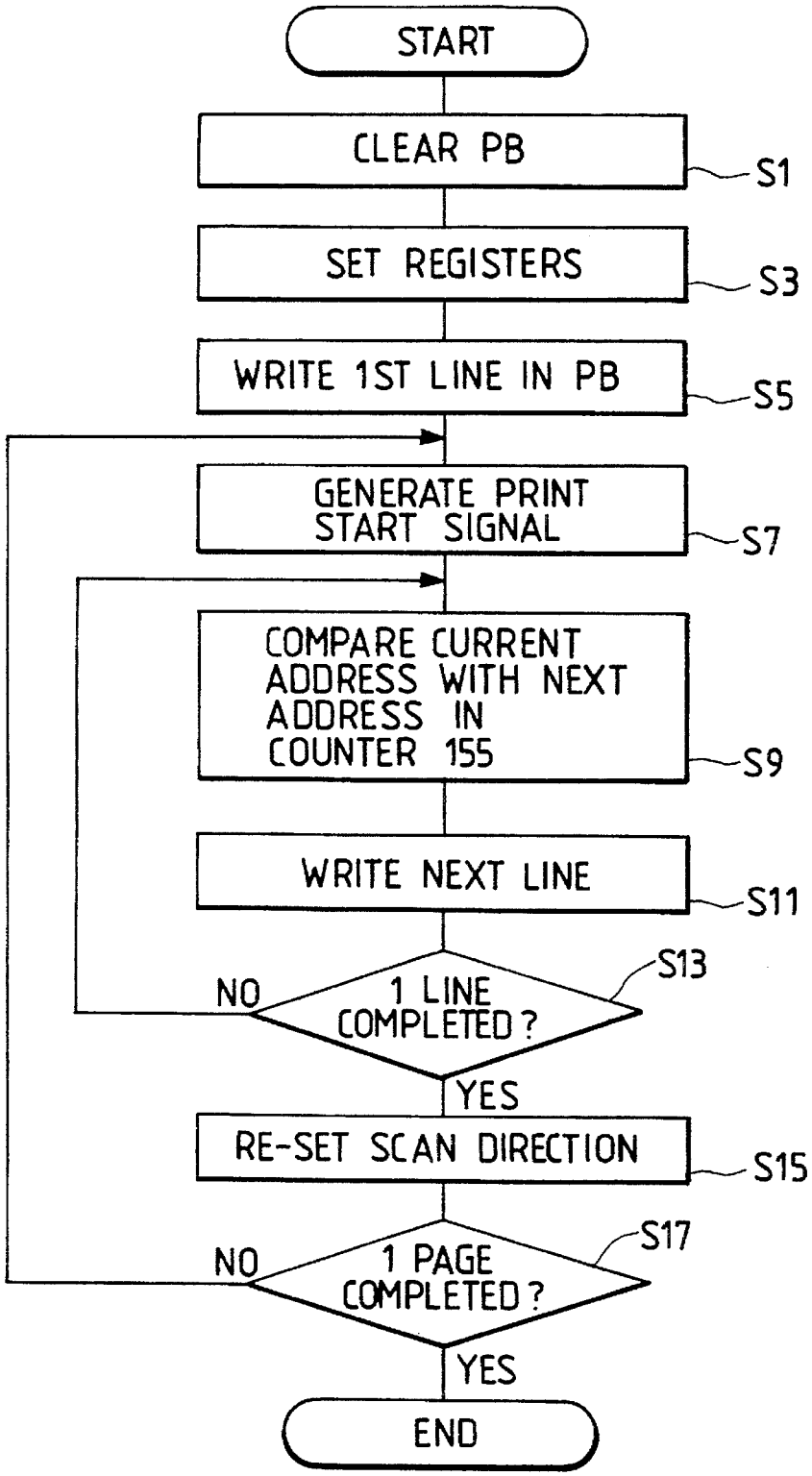
FIG. 16 is a flow chart for explaining an operation sequence in a recording mode.

FIG. 16 is a flow chart showing an operation sequence in the recording mode according to this embodiment.

When this sequence is started, the recording data buffer area PB is entirely cleared to prepare for writing recording data in step S1. In step S3, various registers are set, i.e., a dot count per step, the start and end addresses PBSTART and PBEND of the buffer PB, the recording direction, the start phase pattern of the carriage motor 31, and the like are set. The one-line character codes read out from the reception data buffer IB are stored in a predetermined area of, e.g., the RAM 106 by using the CGROM 108. The stored data serves as dot data of the first line and is written in the recording data buffer PB.

In step S7, the print start signal is output to the address counter 155 and the print timing pulse generator 151 to start a printing operation. During printing, data of the next line corresponding to the end-of-print address position of the buffer PB is written. More specifically, the present value of the address counter 155 is compared with the storage address of the next data (step S9). When the data of the present line is determined as printed data, data of the next line is written at this address (step S11). This write operation is performed by using a period between the common drive signals, i.e., a period A in FIG. 15. Since the recording operation is performed by operations of the address counter and the timing pulse generator, the CPU 100 can perform other processing during any duration of the common drive signals. Reception and processing of data to be stored in the recording data buffer PB will be described later with reference to FIG. 17.

Operations in steps S9 and S11 are performed for each recording position in the scanning direction (step S13). The data of the next line is developed in the buffer area PB at the end of recording of data of one line. At the end of one-line printing, the recording medium is conveyed by a predetermined amount, and re-setting of the scanning direction for performing reciprocative printing is performed in step S15. The procedures after step S7 are repeated until one-page printing is completed.

Figure 17:
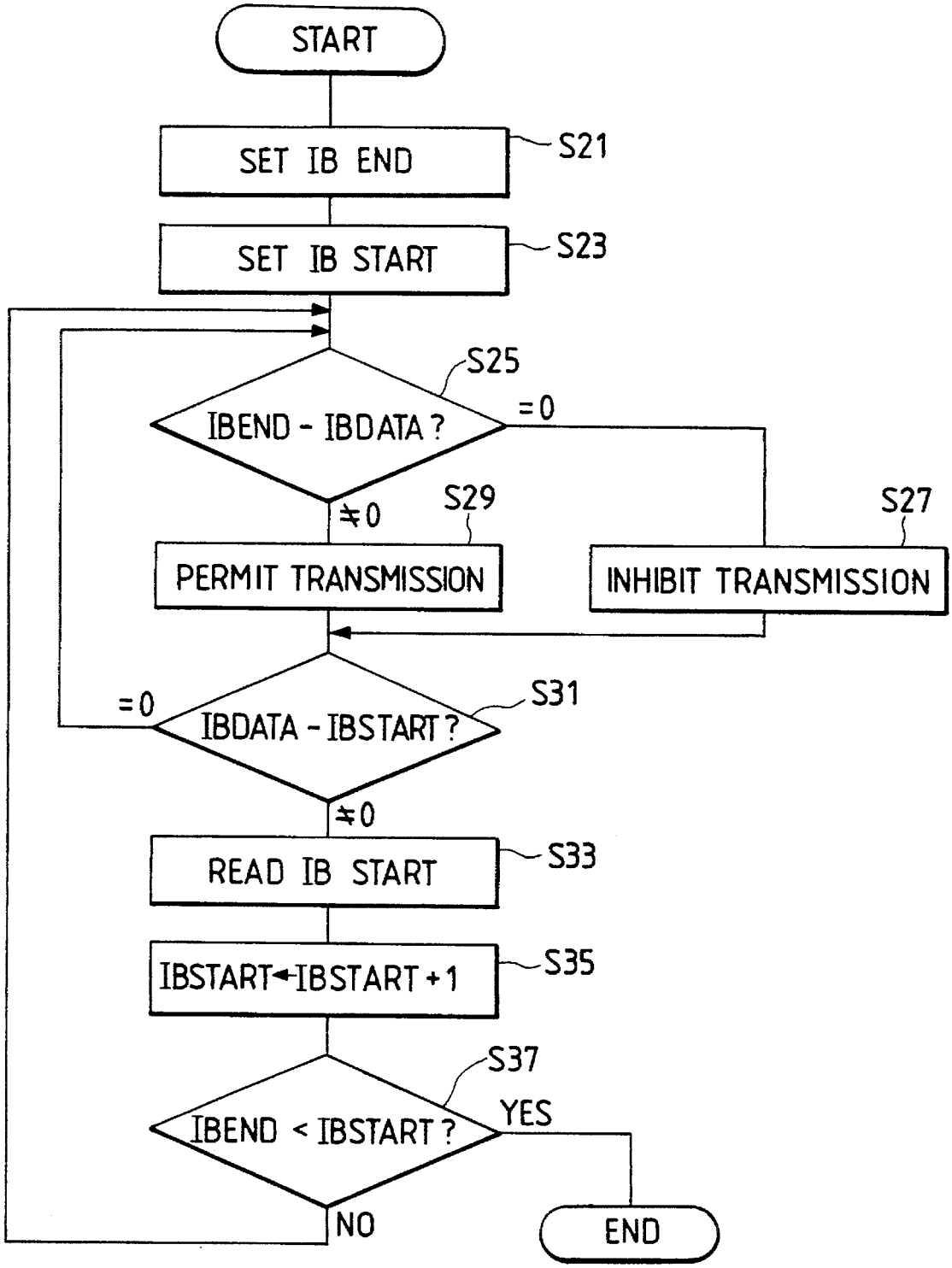
FIG. 17 is a flow chart showing an operation in a data reception mode.

FIG. 17 is a flow chart showing an operation of data reception performed after the common signals COM8 to COM1 are output in FIG. 15, i.e., after recording is performed at a given position in the scanning direction.

In this control sequence, the received data end address IB END is set in the register 181 in step S21. In step S23, the received data start address IB START is set in the register 177.

In step S25, the received data end address IB END is compared with the end-of-data reception address IB DATA. If a coincidence between these addresses is detected, since data reception of one line has been completed, a signal informing that data reception cannot be performed is sent to the data source H. However, if NO in step S27, transmission is enabled in step S29. The operations in steps S25, S27, and S29 are performed such that the BUSY signal is output from the IB control counter 175 at the time of comparison or detection of a coincidence or noncoincidence, or at the time of release. The data source performs data transmission in accordance with the transmission enable operation (release of the BUSY signal).

In step S31, the present values of the end-of-data reception address IB DATA and the start address IB START are compared with each other. If a coincidence is detected, the data source H does not transmit data, so that the CPU waits for data reception. However, when a coincidence is detected, the flow advances to step S33, and the content of the address represented by the present value of the address IB START is read out and developed into dot data. In this manner, the data is stored in a predetermined area of the RAM 106. The stored data is developed in the recording data buffer PB at an appropriate timing during recording, as described above.

The value of the address IB START is incremented by one in step S35. The CPU then determines in step S37 whether the value exceeds the IB END. If YES in step S37, the CPU determines that read access of the one-line received data is completed. In this case, this flow is ended. However, if NO in step S37, the flow returns to step S25, and the operations in the subsequent steps are repeated.

As described above, according to this embodiment, the print timing pulse generator 151 serving as a circuit for transferring the data from the recording data buffer PB to the recording head and the dot step counter 165 serving as a circuit for controlling movement of the carriage are controlled by the common sync signals, so that the CPU 100 concentratedly performs other processing such as data storage of the next line during printing. Therefore, the present invention can cope with high-speed printing in the printer. In addition, these circuits are synchronized with the IB control counter 175 for controlling data reception, so that the load on the CPU 100 during printing can be further reduced, and the print throughput can be further increased.

Figure 18:
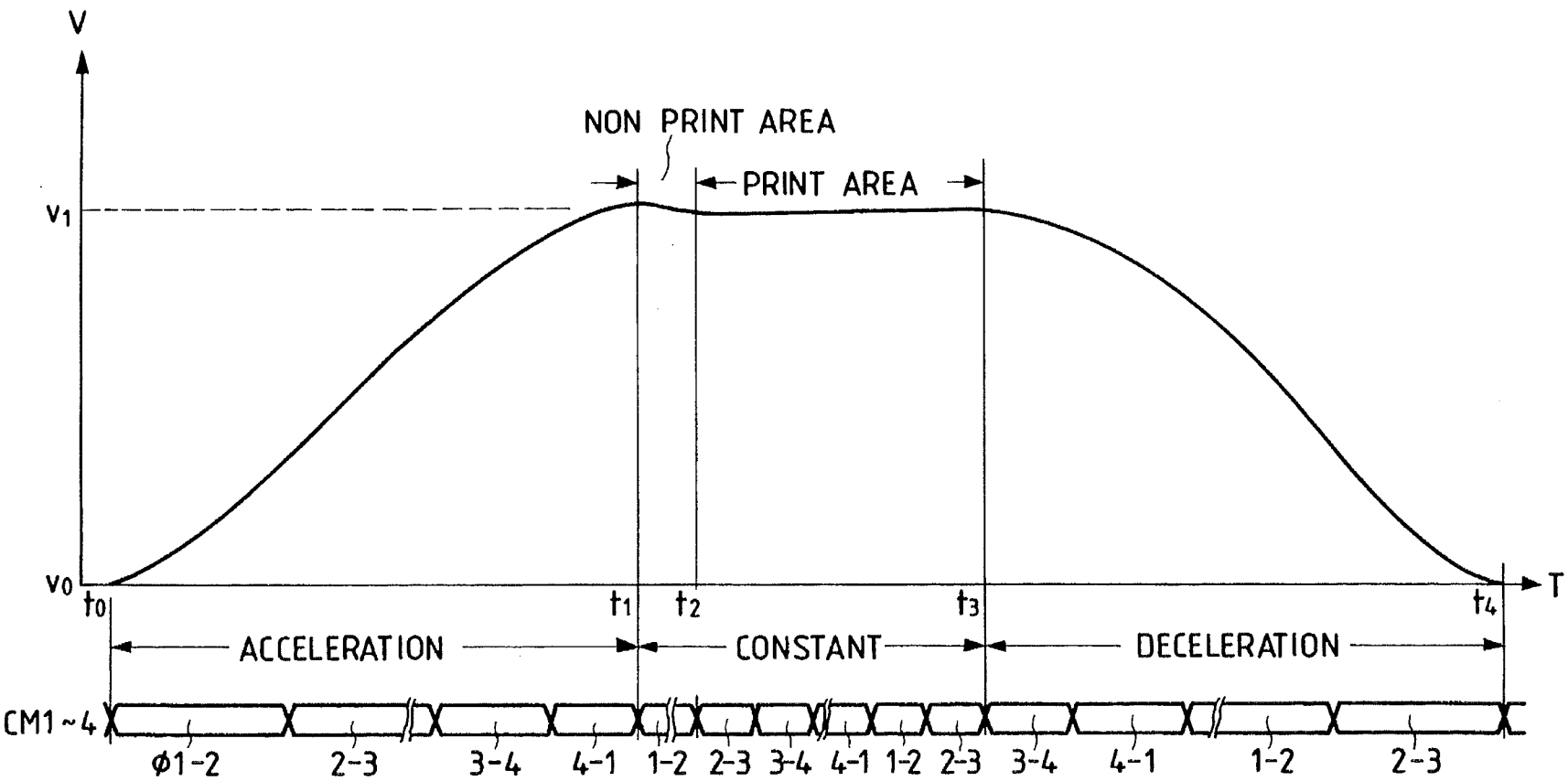
FIG. 18 is a view for explaining a relationship between the carriage speed and the excitation phase switching time of a carriage motor usable in this embodiment.
Figure 19:
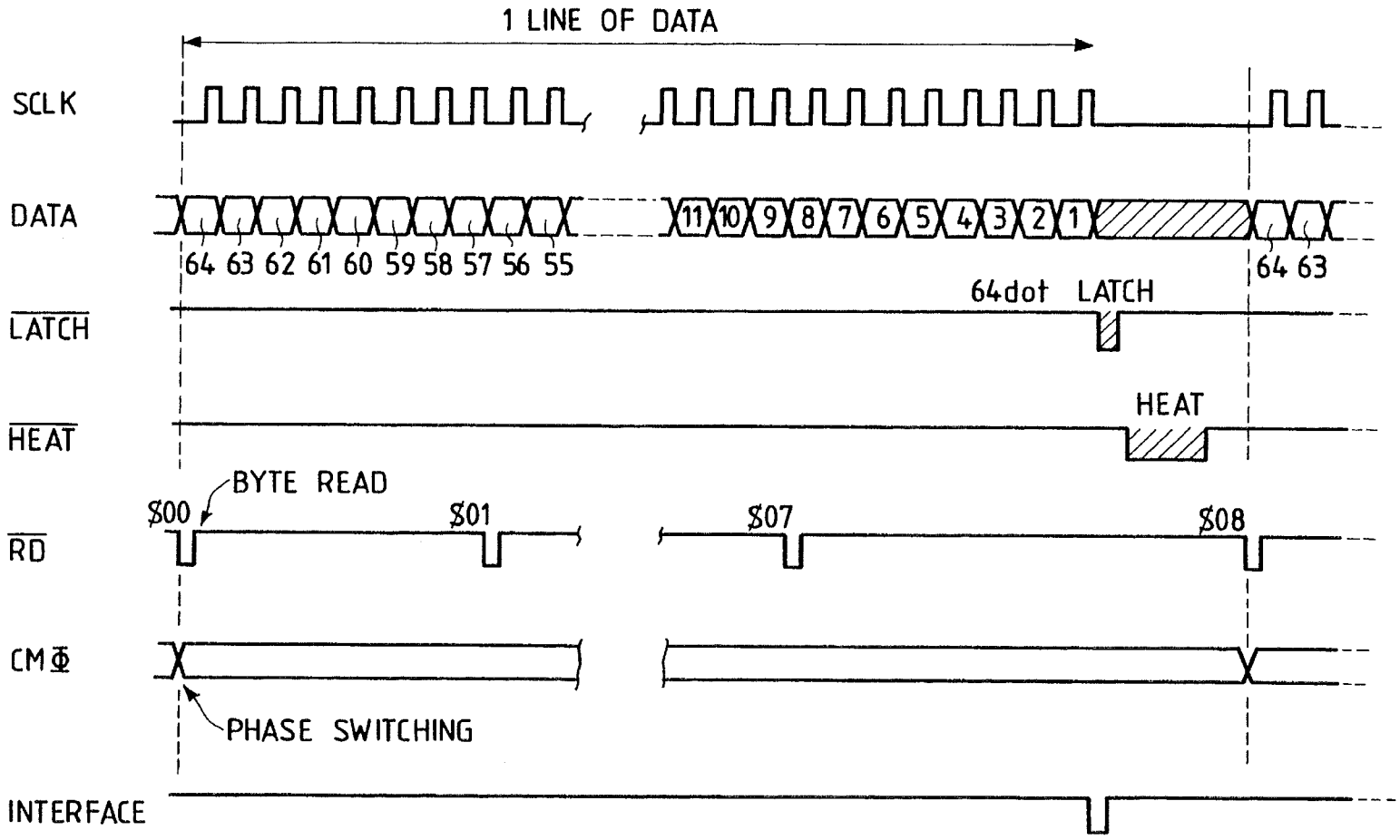
FIG. 19 is a flow chart for explaining another embodiment of the present invention.

FIG. 18 shows a relationship between the excitation phase switching time of the carriage motor 31 usable in this embodiment and the carriage speed in the above embodiment.

At positions before and after the printing area in which the carriage is moved at a constant speed, the carriage is immediately accelerated from an initial speed $V_0$ (=0) to a recording speed $V_1$ (time $t_0$ to time $t_1$) and is then decelerated from the speed $V_1$ to zero (time $t_3$ to time $t_4$) by the ACCEL/DECEL CONTROLLER 171. As soon as the acceleration interval is changed to the constant speed interval, overshooting or undershooting occurs, and an allowable recording speed may not be necessarily obtained. For this reason, as shown in FIG. 18, a region in which printing is not performed during the time interval ($t_1$ to $t_2$) until the speed is stabilized may be provided, and printing is not performed until the speed falls within the allowable speed range. A buffer area corresponding to a few dots from the print start address PB START in the scanning direction is used as a non-print area (i.e., an area in which "0"s are written). The non-print area can be made variable in accordance with a recording speed and an acceleration pattern.

In the above embodiment, data of the next line is written in the buffer PB during recording. However, it is preferable to clear the write address prior to the above write access of the buffer PB. For this purpose, when an address from which print data is read out is immediately cleared, data can be directly written at this address even if the address is not cleared at the time of write access of data of the next line, resulting in convenience. For example, a circuit for clearing the address before the address counter value is updated after data is read out from a set address can be added to the print timing pulse generator 151.

However, when an image in addition to characters is to be recorded using the typewriter of this embodiment, bidirectional printing is preferably inhibited, but recording by one-directional scanning is preferred to improve image quality. In this case, upon completion of one-line recording, the carriage return is performed to return the carriage to a predetermined position. When the carriage return is synchronized with the operation of the print timing pulse generator 151, the stored data of the next line is cleared upon a carriage return. During the carriage return during image recording, clearing or the like is not performed. For this purpose, a read/write signal is not sent to the buffer memory 120 to stop outputting data from the buffer memory 120.

In addition, it is effective to add a command for forcibly stopping an operation of each component during printing. For example, a forcible stop is often required to open the typewriter cover to restart printing. When such a command is input, and the interrupted addressing state is maintained, the operation is started from the next address at the lowermost printing position. Therefore, the operation need not be restarted from the beginning.

Furthermore, the above description has been associated with data reception from the data source serving as a host device. However, the present invention can be applied to a data transmittable interface portion which is then synchronized in data access. This arrangement is effective to transfer data to an external device.

Moreover, the present invention is applicable when a recording head including a shift register, a latch, and a driver is to be used to serially transfer data. In this case, as shown in FIG. 20, serial data is output, data is stored by a shift clock (SCLK) signal and a latch (LATCH) signal, and data is output in response to a heat (HEAT) signal. When a motor excitation phase (CM) is switched upon heating, the motor operations can be synchronized with the heating timings. In addition, in consideration of a reception interface, received data may be read after one-line data is sent, and then the phase may be switched.

In the above embodiment, the recording head is exemplified by an ink-jet recording head. However, a thermal head may be used in place of the ink-jet recording head.

When the present invention is applied to an ink-jet recording apparatus, a bubble-jet recording head provides a best effect in the recording apparatus. According to this system, high-density, high-precision recording can be achieved.

Typical arrangements and principles of the above system are preferably achieved by using fundamental principles disclosed in U.S. Pat. Nos. 4,723,129 and 4,740,796. These systems can be applied to any one of a so-called on-demand scheme and a continuous scheme. In particular, in an on-demand scheme, at least one drive signal is applied to an electrothermal converter arranged in correspondence with a liquid path or a sheet which holds a liquid (ink) to apply an abrupt temperature rise exceeding film boiling in correspondence with recording information, thereby generating heat energy in the electrothermal converter, thereby causing film boiling on a heat-receiving surface of the recording head. As a result, a bubble can be effectively formed in the liquid (ink) in a one-to-one correspondence with the drive signal. The liquid (ink) is ejected through a jet opening by growth/contraction of this bubble, thereby forming at least one droplet. When this drive pulse has a pulse form, growth/contraction of the bubble is instantaneously and appropriately performed. Ejection of the liquid (ink) at a high response speed can be more preferably performed. A preferable pulsed drive signal is described in U.S. Pat. Nos. 4,463,359 and 4,345,262. When conditions described in the specification of U.S. Pat. No. 4,313,124 associated with a rate of temperature rise of the heat-receiving surface are adopted, better recording can be performed.

As a recording head structure, a structure (disclosed in U.S. Pat. Nos. 4,558,333 and 4,459,600) in which a heat-receiving portion is located in a bent portion in addition to the structure (i.e., linear liquid path or orthogonal liquid path) as a combination of the jet ports, the liquid paths, and electrothermal converters, as disclosed in the respective specifications as described above may be incorporated in the present invention. In addition, the effects of the present invention also incorporate an arrangement (Japanese Laid-Open Patent Application No. 59-123670) using a common slit as a jet portion of a plurality of electrothermal converters and an arrangement based on Japanese Laid-Open Patent Application No. 59-138461 in which an opening for absorbing a pressure wave of heat energy is caused to correspond to a jet portion. Recording can be appropriately and efficiently performed regardless of the forms of the recording heads.

In addition, in the serial type printer described above, the present invention is also effective when an interchangeable recording head chip electrically connected to the main body to supply an ink from the main body when it is connected to the main body, or a recording head cartridge including a recording head and an ink cartridge is used.

A recovery means for the recording head and a preliminary auxiliary means are preferably added as components of the printing apparatus of the present invention to further stabilize the effects of the present invention. More specifically, a capping means, a cleaning means, a pressurizing or suction means, an electrothermal converter, and other heating elements, or a preliminary heating means as a combination thereof, and an arrangement for performing a preliminary jet mode different from a recording jet operation are effective to stabilize recording.

The types and number of recording heads are not limited to specific values. For example, only one recording head corresponding to a monochromatic color, or a plurality of recording heads corresponding to a plurality of inks having different recording colors and different densities may be arranged.

In addition, forms of the apparatus of the present invention may be an image output terminal for data processors such as computers, a copying machine in combination with a reader, and a facsimile apparatus having transmission and reception functions.

According to the present invention, since the circuit for transferring the recording data from the storage mans to the head and the circuit for driving and controlling scanning of the recording head are controlled by the common sync signals, the CPU can concentrate itself on data conversion of the next line during printing, so that the present invention can cope with high-speed printing in a printer.

As has been described above, according to the present invention, the circuit for driving and controlling scanning of the recording head and the data communication circuit are synchronously driven to reduce the load on the CPU and allow high-speed printing. Since the circuit for transferring the recording data from the storage means to the recording head is also controlled by the common sync signals, the load on the CPU can be further reduced.

What is claimed is:

1. A printer controller apparatus comprising:

first memory means for storing inputted first data;

first control means for processing the first data stored in said first memory means;

second memory means for storing the first data processed by said first control means as second data;

a recording head for recording data based on the second data stored in said second memory means;

a carriage for mounting said recording head and moving in a direction normal to a paper feed direction; and second control means for controlling inputting of the first data into said first memory means, transferring of the second data from said second memory means to said recording head, and moving of said carriage, wherein said first and second control means execute their respective control operations in parallel with each other.

2. An apparatus according to claim 1, wherein said recording head causes a volume change in ink through thermal energy to eject the ink.

3. An apparatus according to claim 1, wherein said first and second memory means comprise respective different storage areas of the same one memory.

4. An apparatus according to claim 1, wherein said second memory means stores a plurality of lines of the second data.

5. An apparatus according to claim 1, further comprising a keyboard for inputting the first data and a display for displaying data based on the input data.

6. An apparatus according to claim 1, wherein said second control means controls inputting of the first data into said first memory means from an external apparatus through an interface.

7. An apparatus according to claim 1, wherein said second control means controls the inputting of the first data, the transferring of the second data and the moving of said carriage in accordance with the same clock.

* * * * *

UNITED STATES PATENT AND TRADEMARK OFFICE

CERTIFICATE OF CORRECTION

PATENT NO. : 5,485,178

DATED : January 16, 1996

INVENTOR(S) : Jiro TATEYAMA, et al.

It is certified that error appears in the above-indentified patent and that said Letters Patent is hereby corrected as shown below:

On the title page, item [54] and column 1, lines 1-4,

AT [54] TITLE:

"PRINTER CONTROL APPARATUS FOR SYNCHRONOUSLY CONTROLLING DRIVING OF RECORDING HEAD AND TRANSFER OF DATA" should read --PRINTER CONTROL APPARATUS FOR CONTROLLING PROCESSING OF INPUT DATA AND DRIVING OF RECORDING HEAD IN PARALLEL--.

AT [56] REFERENCES CITED - U.S. PATENT DOCUMENTS:

"4,517,578 5/1985 Tazari" should read --4,517,578 5/1985 Tazaki--.

AT [57] ABSTRACT:

"A control apparatus of a printer causes a recording head to form an image by a dot matrix while scanning the recording head in a predetermined direction relative to a recording medium. The control apparatus includes a transfer unit for transferring recording data stored in a memory to the recording head, a drive control unit for driving and controlling scanning of the

UNITED STATES PATENT AND TRADEMARK OFFICE

CERTIFICATE OF CORRECTION

PATENT NO. : 5,485,178 Page 2 of 3

DATED : January 16, 1996

INVENTOR(S) : Jiro TATEYAMA, et al.

It is certified that error appears in the above-indentified patent and that said Letters Patent is hereby corrected as shown below:

recording head, and a synchronizing unit for synchronously driving the transfer unit and the drive control unit." should read --The printer controller apparatus includes a first memory for storing inputted first data and a first controller for processing the first data stored in the first memory. A second memory stores the first data processed by the first controller as second data, a recording head records data based on the second data and a carriage mounts the recording head and moves in a direction normal to a paper feed direction. A second controller controls inputting of the first data into the first memory, transferring of the second data from the second memory to the recording head and moving of the carriage. The first and second controllers execute their respective control operations in parallel with each other.--.

UNITED STATES PATENT AND TRADEMARK OFFICE

CERTIFICATE OF CORRECTION

PATENT NO. : 5,485,178 Page 3 of 3

DATED : January 16, 1996

INVENTOR(S) : Jiro TATEYAMA, et al.

It is certified that error appears in the above-indentified patent and that said Letters Patent is hereby corrected as shown below:

COLUMN 4:

Line 20, "a-carriage" should read --a carriage--;

Line 48, "injecting" should read --ejecting--.

COLUMN 6:

Line 7, "cuter" should read --outer--.

Signed and Sealed this

Second Day of July, 1996

*Attest:*

*Attesting Officer*

BRUCE LEHMAN

*Commissioner of Patents and Trademarks*